US011174069B2

(12) United States Patent
Forrest et al.

(10) Patent No.: US 11,174,069 B2
(45) Date of Patent: Nov. 16, 2021

(54) CAN END

(71) Applicant: Rexam Beverage Can Company, Chicago, IL (US)

(72) Inventors: Randall G. Forrest, Park Ridge, IL (US); Michael R. Gogola, Itasca, IL (US)

(73) Assignee: REXAM BEVERAGE CAN COMPANY, Westminster, CO (US)

( * ) Notice: Subject to any disclaimer, the term of this patent is extended or adjusted under 35 U.S.C. 154(b) by 199 days.

(21) Appl. No.: 15/817,600

(22) Filed: Nov. 20, 2017

(65) Prior Publication Data

US 2018/0072453 A1 Mar. 15, 2018

Related U.S. Application Data

(63) Continuation of application No. 13/471,218, filed on May 14, 2012, now Pat. No. 9,821,928.

(51) Int. Cl.
*B65D 6/34* (2006.01)
*B65D 17/28* (2006.01)

(52) U.S. Cl.
CPC ..... *B65D 7/44* (2013.01); *B65D 17/4012* (2018.01)

(58) Field of Classification Search
CPC .... B65D 17/08; B65D 17/163; B65D 17/165; B65D 17/4012; B65D 7/44
USPC ..... 220/669, 265, 266, 268, 269, 270, 619; 413/6
See application file for complete search history.

(56) References Cited

U.S. PATENT DOCUMENTS 3,843,014 A 10/1974 Cospen et al.
4,808,052 A 2/1989 Bulso, Jr. et al.
4,832,223 A 5/1989 Kalenak et al.
5,149,238 A * 9/1992 McEldowney ..... B21D 51/44 413/8
5,356,256 A 10/1994 Turner et al.
(Continued)

FOREIGN PATENT DOCUMENTS

EP 0103074 A2 3/1984
JP 2008264880 11/2008

OTHER PUBLICATIONS

International Search Report from pending International Application No. PCT/US2013/040873 dated Aug. 22, 2013 by the EPO (5 pages).

*Primary Examiner* — Jeffrey R Allen
(74) *Attorney, Agent, or Firm* — Greer, Burns & Crain, Ltd.

(57) ABSTRACT

A can end has a public side and an opposing product side. A circumferential curl is located about a center axis and defines an outer perimeter of the can end. A circumferential wall extends downwardly from the curl. A circumferential, generally U-shaped countersink extends radially inwardly from the circumferential wall relative to the center axis and upwardly. A center panel extends radially inwardly from the countersink relative to the center axis and has a displaceable tear panel defined by frangible score and a hinge segment on the public side and a tab fixed to the public side which has a nose portion overlying a portion of the displaceable tear panel. A circumferential panel joins the countersink with the center panel and has a first panel radius joined to a second panel radius by a short wall extending upwardly and inwardly. The circumferential panel has a bead formed therein.

15 Claims, 23 Drawing Sheets

(56) References Cited

U.S. PATENT DOCUMENTS

| | | | | |
|---|---|---|---|---|
| 5,527,143 | A | 6/1996 | Turner et al. | |
| 5,590,807 | A | 1/1997 | Forrest et al. | |
| 5,598,734 | A | 2/1997 | Forrest et al. | |
| 5,749,488 | A | 5/1998 | Bagwell et al. | |
| 6,024,239 | A | 2/2000 | Turner et al. | |
| 6,234,336 | B1 | 5/2001 | Neiner | |
| 6,419,110 | B1 | 7/2002 | Stodd | |
| 6,460,723 | B2 | 10/2002 | Nguyen et al. | |
| 6,516,968 | B2 | 2/2003 | Stodd | |
| 6,736,283 | B1 | 5/2004 | Santamaria et al. | |
| 6,748,789 | B2 | 6/2004 | Turner et al. | |
| 6,761,280 | B2 | 7/2004 | Zonker et al. | |
| 7,341,163 | B2 | 3/2008 | Stodd | |
| 7,370,774 | B2 | 5/2008 | Watson et al. | |
| 7,478,550 | B2 | 1/2009 | Wynn et al. | |
| 7,591,392 | B2 | 9/2009 | Watson et al. | |
| 7,748,563 | B2 | 7/2010 | Turner et al. | |
| 8,011,527 | B2 | 9/2011 | Forrest et al. | |
| 2003/0010785 | A1 | 1/2003 | Stodd | |
| 2003/0012924 | A1 | 7/2003 | Stodd | |
| 2003/0121920 | A1 | 7/2003 | Zonker et al. | |
| 2004/0074911 | A1 | 4/2004 | Stodd | |
| 2004/0211786 | A1 | 10/2004 | Turner et al. | |
| 2004/0238546 | A1 | 12/2004 | Watson et al. | |
| 2005/0029269 | A1 | 2/2005 | Stodd et al. | |
| 2005/0252922 | A1 | 11/2005 | Reed et al. | |
| 2007/0029324 | A1 | 2/2007 | Watson et al. | |
| 2010/0044383 | A1 | 2/2010 | Watson et al. | |
| 2010/0059517 | A1 | 3/2010 | An | |
| 2011/0031256 | A1 * | 2/2011 | Stodd ..... | B21D 51/32 220/621 |
| 2011/0297679 | A1 | 12/2011 | Gogola et al. | |

* cited by examiner

CAN END

CROSS-REFERENCE TO RELATED APPLICATIONS

This application is a continuation of co-pending application Ser. No. 13/471,218 filed on May 14, 2012, issued on Nov. 21, 2017 as U.S. Pat. No. 9,821,928. The applications are commonly assigned and incorporated by reference herein.

FEDERALLY SPONSORED RESEARCH OR DEVELOPMENT

None.

TECHNICAL FIELD

The invention relates to beverage can end shells and converted can ends; more particularly, the present invention relates to a can end produced from a down-gauged metal blank without adversely affecting the strength of the can end.

BACKGROUND OF THE INVENTION

Common end closures for beer and beverage containers have a central panel that has a frangible panel (sometimes called a "tear panel," "opening panel," or "pour panel") defined by a score formed on the outer surface, the "public side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin plate of aluminum. End closures for such containers are also typically constructed from a cut-edge of thin plate of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

These types of "stay-on-tab" ecology container ends have been used for many years, with a retained tab and a tear panel of various different shapes and sizes. Throughout the use of such ends, manufacturers have sought to save the expense of the metal by down-gauging the metal of the ends and the tabs. However, because ends are used for containers with pressurized contents and are sometimes subject to pasteurization, there are conditions causing great stresses to the components of the end during pasteurization, transit and during opening by a user. These conditions limit the available gauge reduction of the end metal, and make it difficult to alter design characteristics of the end, such as by reducing metal gauge or the thickness of the metal residual in the score defining the tear panel.

The pressurized contents of the container often cause risk for the end to buckle. The pressurized contents may also result in a condition in which the tab is forced upwardly. There is a maximum allowable distance that the tab can be displaced without the tab extending upwardly above the remainder of the container. This is called tab-over-chime. Tab-over-chime leads to ship abuse problems wherein the frangible panel prematurely fractures during distribution of filled beverage containers.

As manufacturers reduce the thickness of the metal used to make the ends, buckle and tab-over-chime become more and more of a problem. Therefore, a need for can end with improved ability to withstand buckle and tab-over-chime is needed.

Finished can ends, also referred to as reformed or converted can ends, are available in many sizes. The different sizes are generally identified as 200, 202, 206, and 209. The sizes are distinguished, in part, by their respective diameters. The 200 can end is the smallest, and the 209 is the largest.

A can end similar to one described in U.S. Pat. No. 7,819,275, which is hereby incorporated by reference as if fully set forth herein, has gained some commercial acceptance. A can shell illustrated in FIG. 13 of the '275 patent includes a circular center panel connected to a short, inclined, beveled panel wall. The inclined or beveled panel wall has straight inner and outer surfaces and extends at an acute angle, and connects through a vertical wall with an inclined inner wall of a countersink, which has a generally U-shaped cross-sectional configuration. The countersink has an inclined outer wall and connects with a chuckwall having an inclined or curved upper wall portion and an inclined lower wall portion. An upper portion of the chuckwall connected to an inner wall portion of a crown having a curved outer wall.

The can end shell depicted in FIG. 13 of the '275 patent is generally formed from aluminum sheet having a thickness of about 0.0082 ins. When produced from thick aluminum stock such as this, the seamed can end reportedly exhibits suitable resistance to buckle. The configuration and relative shallow profile of the can shell also result in a seamed can end having an overall height of less than 0.240 ins, thus providing for a reduction of over 0.040 inch in the diameter of the circular blank which is used to form the shell. This reduction in diameter reportedly results in a significant reduction in the width of aluminum sheet used to produce the shells, thus a reduction in the weight and cost of aluminum to form can ends.

Co-pending and commonly assigned U.S. patent application Ser. No. 12/795,434 filed on Jun. 7, 2010, which is hereby incorporated by reference as if fully set forth herein, describes can ends or lids for two-piece metallic beverage cans produced from a reduced volume of metal, notably a blank of a reduced thickness. The can ends of the '434 application are generally 209 sized can ends having a diameter of at least 60 mm, more likely about 70 mm or slightly less than 70 mm, about 65 mm when seamed to a can body.

It is desired to produce a can end which is produced from a metal blank having a thickness less than 0.0082 ins while maintaining an adequate buckle strength greater than 100 psi.

Generally, can end shells, i.e. those produced in a shell press, will exhibit dimensional variability, especially in the countersink area. It is believed that this is caused by grain orientation in the metal, primarily aluminum alloy, blanks used to produce the can end shells. Thus, from can end shell to can end shell, the dimensions will be fairly consistent. However, about the countersink of a single can end shell the dimensions will vary. Stated another way, inter-can end shell variability will generally be low while intra-can end shell variability can be relatively high.

A converted or finished can end produced from a can end shell exhibiting the inconsistency or variability described above can lead to difficulty in double seaming the converted can end to a can body because the seaming chuck inserted within the public side of the can end during seaming will not fit within the countersink exactly the same about the circumference of the can end. Therefore, the circumferential double seam may become undesirably variable or prone to failure.

The present invention is provided to solve the problems discussed above and other problems, and to provide advantages and aspects not provided by prior can ends or lids of this type. A full discussion of the features and advantages of the present invention is deferred to the following detailed description, which proceeds with reference to the accompanying drawings.

SUMMARY OF THE INVENTION

A first aspect of the present invention is directed to a can end. The can end comprises a public side and an opposing product side. A circumferential curl is located about a center axis and defines an outer perimeter of the can end. A circumferential wall extends downwardly from the curl. A circumferential, generally U-shaped countersink extends radially inwardly from the circumferential wall relative to the center axis and upwardly. A center panel extends radially inwardly from the countersink relative to the center axis and comprises a displaceable tear panel defined by frangible score and a hinge segment on the public side and a tab fixed to the public side having a nose portion overlying a portion of the displaceable tear panel. A circumferential panel joins the countersink with the center panel. The circumferential panel comprises a first panel radius joined to a second panel radius by a short wall extending upwardly and inwardly. The circumferential panel has a bead formed therein.

The first aspect of the invention may comprise one or more of the following features, alone or in any reasonable combination. The can end may further comprise a first convex bend relative to the public side and a second convex bend relative to the public side on the short wall wherein the bead is located therebetween. The bead may be located on the short wall. The bead may be defined by a formation in the can end wherein deformation of the public side and the product side are substantially uniform, such that the public side and the product side 35 remain substantially parallel throughout the bead structure. The can end may further comprise a convex bend relative to the public side located between the bead and the first panel radius. The can end may further comprise a convex bend relative to the public side located between the bead and the second panel radius. The short wall may extend upwardly and radially inwardly relative to the center axis at an angle between about 15° and 75° as measured from a vertical axis, and the first panel radius may have a first coined segment formed therein. The can end may further comprise a second coined segment formed in the second panel radius. The first panel radius may be directly joined to the countersink, and the second panel radius may be directly joined to an outer peripheral edge of the center panel.

A second aspect of the invention is directed to a can end. The can end has a public side and an opposing product side wherein a thickness of the can end measured between the public side and the product side is less than 0.0082 ins. A circumferential curl is located about a center axis and defines an outer perimeter of the can end. A circumferential wall extends downwardly from the curl. The circumferential, generally U-shaped countersink extends radially inwardly from the circumferential wall relative to the center axis and upwardly. A center panel extends radially inwardly from the countersink relative to the center axis and comprises a displaceable tear panel defined by frangible score and a hinge segment on the public side and a tab fixed to the public side having a nose portion overlying a portion of the displaceable tear panel. A circumferential panel joins the countersink with the center panel and has a first panel radius and a second panel radius. The circumferential panel has one or more features formed therein providing locally additional material from which to form a substantially vertical, radially inner wall of the countersink having a sufficient length wherein the can end exhibits a buckle strength greater than or equal to 100 psi.

The second aspect of the invention may comprise one or more of the following features, alone or in any reasonable combination. The circumferential panel may have a lowermost point and an uppermost point wherein an angle of a straight line drawn from the lowermost point to the uppermost point is between 30° and 60° as measured from a vertical axis. A segment of the circumferential panel between the first and second points lies on the straight line. A first feature may be a concave bead relative to the public side. The feature may be a coined segment of either the first panel radius or the second panel radius. The circumferential panel may have a lowermost point and an uppermost point wherein an angle of a straight line drawn from the lowermost point to the uppermost point is about 45° and wherein a segment of the circumferential panel between the first and second points lies on the straight line.

A third aspect of the invention is directed to a can end. The can end comprises a public side and an opposing product side. A circumferential curl is located about a center axis and defines an outer perimeter of the can end. A circumferential wall extends downwardly from the curl. A circumferential, generally U-shaped countersink extends radially inwardly from the circumferential wall relative to the center axis and upwardly. A center panel extends radially inwardly from the countersink relative to the center axis and comprises a displaceable tear panel defined by frangible score and a hinge segment on the public side and a tab fixed to the public side having a nose portion overlying a portion of the displaceable tear panel. A circumferential panel joins the countersink with the center panel and has a bead formed therein. The bead comprises a first segment extending radially inwardly relative to the center axis and downwardly from a radially outermost portion of the circumferential panel. The bead may be defined by a formation in the can end wherein deformation of the public side and the product side are substantially uniform, such that the public side and the product side 35 remain substantially parallel throughout the bead structure.

The third aspect of the invention may comprise one or more of the following features, alone or in any reasonable combination. The can end may further comprise a convex bend relative to the public side located between the countersink and the bead. The can end may further comprise a convex bend relative to the public side located between the bead and an outer periphery of the center panel. The bead may be defined by a formation in the can end wherein deformation of the public side and the product side are substantially uniform, such that the public side and the product side 35 remain substantially parallel throughout the bead structure.

A fourth aspect of the present invention is directed to a can end. The can end comprises a public side and an opposing product side wherein a thickness of the can end measured between the public side and the product side is less than 0.0082 ins. A circumferential curl is located about a center axis and defines an outer perimeter of the can end. A circumferential wall extends downwardly from the curl. A circumferential, generally U-shaped countersink extends radially inwardly from the circumferential wall relative to the center axis and upwardly. A center panel extends radially inwardly from the countersink relative to the center axis and comprises a displaceable tear panel defined by frangible score and a hinge segment on the public side and a tab fixed to the public side having a nose portion overlying a portion of the displaceable tear panel. A circumferential panel joins the countersink with the center panel and has a first panel radius joined to a second panel radius wherein the circumferential panel has a lowermost point and an uppermost point wherein an angle of a straight line drawn from the lowermost point to the uppermost point is between about 30° and 60° as measured from a vertical axis and wherein a segment of the circumferential panel between the first and second points lies on the straight line. The circumferential panel has a feature formed therein providing additional material of the thickness from which to form a substantially vertical radially inner wall of the countersink wherein the feature comprises a convex bend relative to the public side.

A fifth aspect of the present invention is directed to a can end. The can end has a public side and an opposing product side. A circumferential curl is located about a center axis and defines an outer perimeter of the can end. A circumferential wall extends downwardly from the curl. A circumferential, generally U-shaped countersink extends radially inwardly from the circumferential wall relative to the center axis and upwardly. A center panel extends radially inwardly from the countersink relative to the center axis comprises a displaceable tear panel defined by frangible score and a hinge segment on the public side and a tab fixed to the public side having a nose portion overlying a portion of the displaceable tear panel. A circumferential panel joins the countersink with the center panel has a first panel radius joined to a second panel radius by a short wall having a first segment extending radially inwardly relative to the center axis, a second segment comprising a concave bend relative to the public side and a third segment extending upwardly and radially inwardly relative to the center axis.

A sixth aspect of the present invention is directed to a can end. The can end has a public side and an opposing product side. A circumferential curl is located about a center axis and defines an outer perimeter of the can end. A circumferential wall extends downwardly from the curl. A circumferential, generally U-shaped countersink extends radially inwardly from the circumferential wall relative to the center axis and upwardly. A center panel extends radially inwardly from the countersink relative to the center axis and has a displaceable tear panel defined by frangible score and a hinge segment on the public side and a tab fixed to the public side having a nose portion overlying a portion of the displaceable tear panel. A circumferential panel joins the countersink with the center panel and has a bead formed therein. The bead comprises a first segment extending radially inwardly relative to the center axis and downwardly from an uppermost portion of the circumferential panel.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
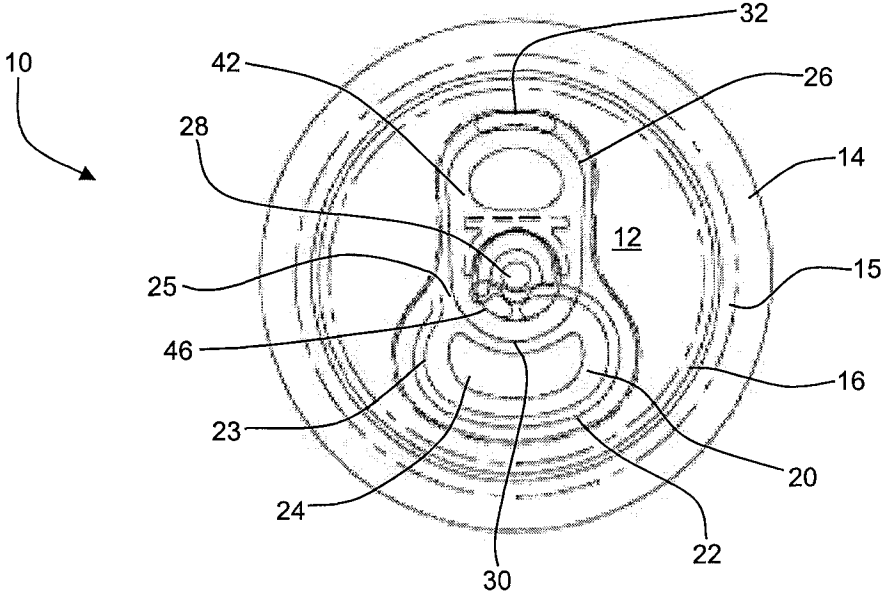
FIG. 1 is a top plan view of a converted can end.

While this invention is susceptible of embodiments in many different forms, there are shown in the drawings and will herein be described in detail preferred embodiments of the invention with the understanding that the present disclosures are to be considered as exemplifications of the principles of the invention and are not intended to limit the broad aspect of the invention to the embodiments illustrated.

Referring to the figures, can ends, converted can ends 10 and can end shells 100, are illustrated. Can ends for beverage containers are typically constructed from a cutedge of thin plate of aluminum or steel, formed into blank end, and manufactured into a finished end by a process often referred to as end conversion. In the embodiments shown in the figures, a center or central panel 12 is joined to a container by a seaming curl 14 which is joined to a mating curl of a container. The seaming curl 14 of the end closure 10 is integral with the central panel 12 by a downwardly extending wall 15 and a strengthening member 16, typically either a countersink or a triple fold, which is joined to the panel outer edge 18 of the central panel 12.

Figure 3:
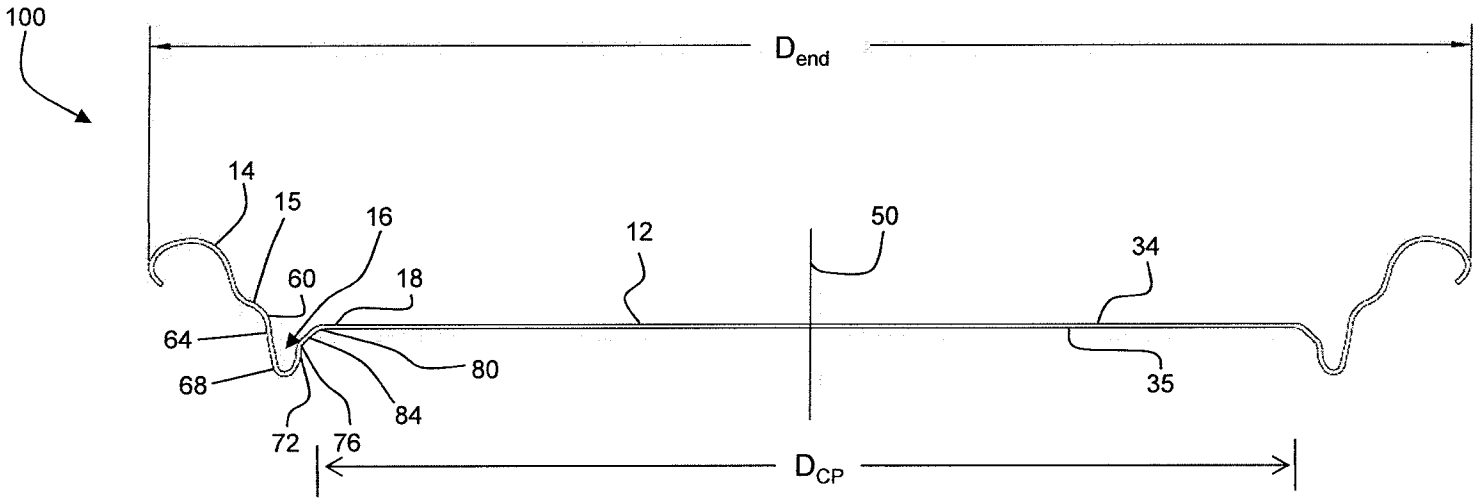
FIG. 3 is a cross-sectional view of a can end shell.
Figure 4:
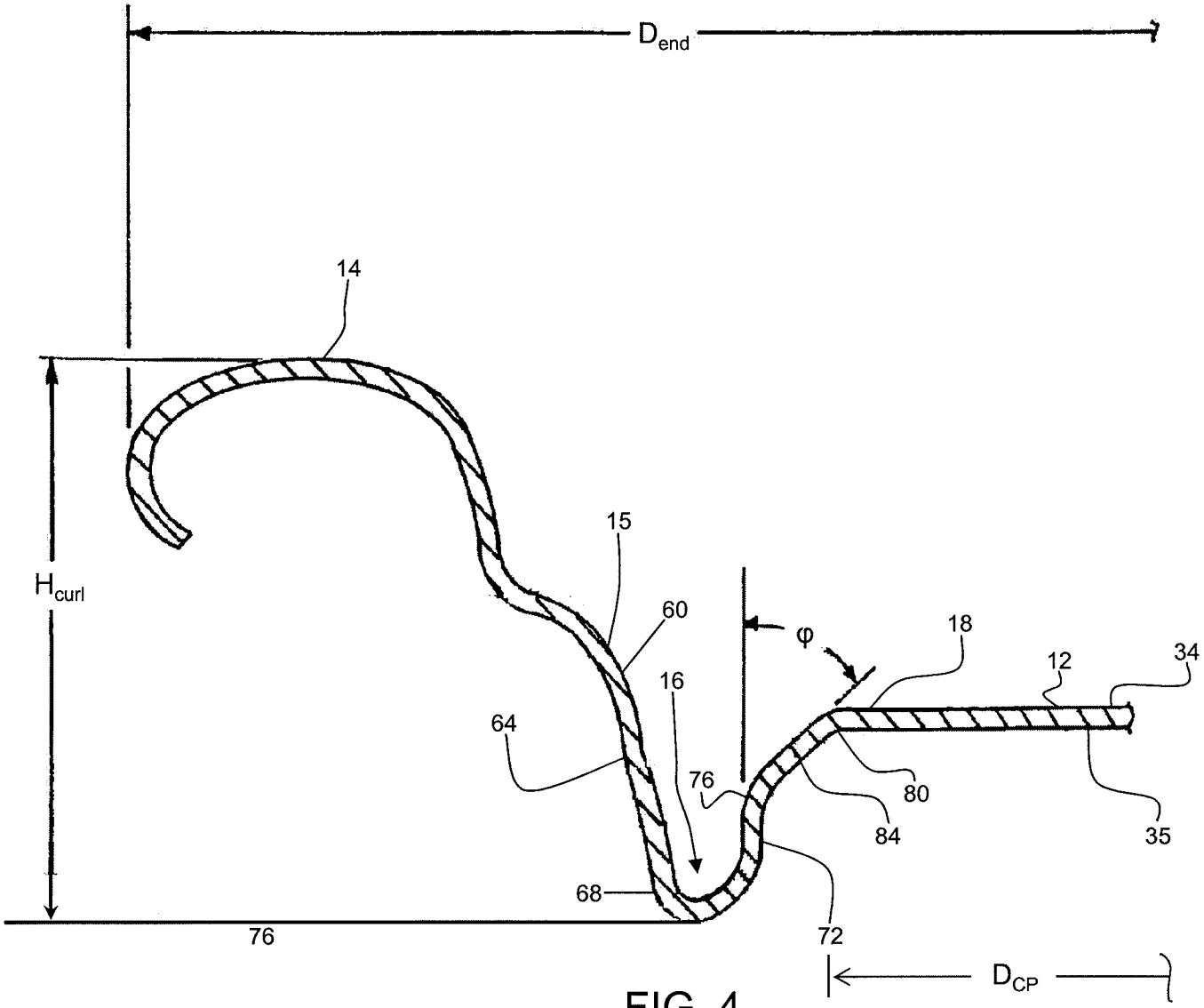
FIG. 4 is a partial cross-sectional view of a can end, shell or converted can end.

The steps of manufacturing begin in a can end shell press with blanking the cutedge, typically a round or non-round cutedge of thin metal plate. Examples of non-round cutedge blanks include elliptical cutedges, convoluted cut edges, and harmonic cut edges. A convoluted cutedge may be described as generally having three distinct diameters, each diameter being 45° relative to the others. The cutedge is then formed into a blank end by forming the seaming curl, countersink, panel radius and the central panel. FIG. 3 shows a can end shell 100.

Figure 2:
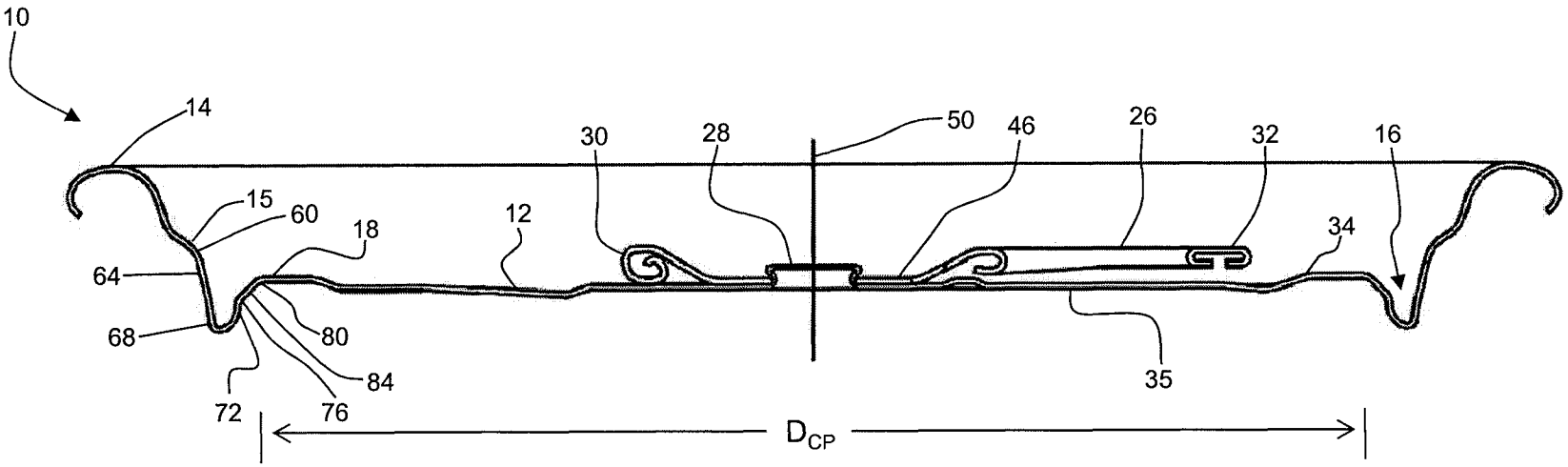
FIG. 2 is a cross-sectional view of the converted can end of FIG. 1.

A means for opening the can end or accessing the contents of the container is typically formed in a conversion process for this type of end closure and performed in a conversion press. This process includes the following steps: forming a rivet by first forming a projecting bubble in the center of the panel and subsequently working the metal of the bubble into a button and into the more narrow projection of metal being the rivet; forming the tear panel by scoring the metal of the panel wall; forming an inner bead or panel on the tear panel; forming a deboss panel by bending the metal of the panel wall such that a central area of the panel wall is slightly lower than the remaining panel wall; staking the tab to the rivet; and other subsequent operations such as wipe-down steps to remove sharp edges of the tab, lettering on the panel wall by scoring, incising, or embossing (or debossing), and restriking the rivet island. FIG. 2 shows a converted can end 10.

For the sake of this description and the claims, the term "can end" includes both converted of finished can ends as well as can end shells which have not been processed through a conversion press. More detailed explanation follows.

The central panel wall 12 is generally centered about a longitudinal or center axis 50 and has a displaceable tear panel 20 defined by a frangible score 22 and a non-frangible hinge segment 25. The tear panel 20 of the central panel 12 may be opened, that is the frangible score 22 may be severed and the tear panel 20 displaced at an angular orientation relative to the remaining portion of the central panel 12, while the tear panel 20 remains hinged to the central panel 12 through the hinge segment. In this opening operation, the tear panel 20 is displaced at an angular deflection. More specifically, the tear panel 20 is deflected at an angle relative to the plane of the panel 12, with the vortex of the angular displacement being the hinge segment.

The tear panel 20 is formed during the conversion process by a scoring operation and preferably has a surface area greater than 0.5 $in^2$ (3.23 $cm^2$). The tools for scoring the tear panel 20 in the central panel 12 include an upper die on a public side 34 having a scoring knife edge in the shape of the tear panel 20, and a lower die on a product side 35 to support the metal in the regions being scored. When the upper and lower dies are brought together, the metal of the panel wall 12 is scored between the dies. This results in the scoring knife edge being embedded into the metal of the panel wall 12, forming the score which appears as a wedge-shaped recess in the metal. The metal remaining below the wedge-shaped recess is the residual of the score 22. Therefore, the score 22 is formed by the scoring knife edge causing movement of metal, such that the imprint of the scoring knife edge is made in the public side 34 of the panel wall 12.

The tear panel 20 may also include an anti-fracture score 23. The anti-fracture score is generally located radially inwardly of the frangible score 22, except in the hinged region 25, and generally follows the contour of the frangible score 22. The anti-fracture score is provided to reduce residual stresses associated with the primary score line so as to prevent or minimize the occurrence of microcracks in, or premature fracture along, the frangible score line 22. Thus, a score line may include both the frangible score 22 and the anti-fracture score 23 in combination or, as will be described, solely the frangible score 22.

The tear panel 20 may further include a down panel 24. The down panel 24 forms a recessed segment between approximately 10 o'clock and 2 o'clock locations on the tear panel 20, using a clock-like orientation wherein a center of the clock-like orientation is defined by a central axis extending through a rivet 28 which is perpendicular to a transverse axis extending through a widest segment of the displaceable tear panel 20 and wherein a segment of the central axis defines a 12 o'clock to 6 o'clock distance. From the recessed segment toward the 6 o'clock position on the tear panel 20, the down panel 24 gently decreases in depth until it blends smoothly with adjacent areas of the tear panel 24 between approximately the 4 o'clock position clockwise to approximately the 8 o'clock position and remaining at least somewhat recessed from approximately the 8 o'clock position clockwise to approximately the 4 o'clock position.

The inventors are also aware of tear panels having circumferential up or convex beads and circumferential reverse, down, or concave beads.

The central panel 12 further includes a tab 26. The tab 26 has a generally elongated body with a central axis defined by a central cross section through the tab nose 30, and through a central webbing 42 and the lift end 32. Typical prior art container ends often have a tab 26 which is staked in the final steps of the conversion process by staking the area of the panel wall 12 adjacent and under the rivet island 46 at an angle, to bias the tab 26 such that the lift end 32 of the tab 26 rests close to the panel wall 12. The central panel 12 may also have a recess near the lift end 32 of the tab 26 to allow for easier finger access.

The opening of the tear panel 20 is operated by the tab 26 which is attached to the central panel 12 by the rivet 28, generally through a rivet hole. The tab 26 is attached to the central panel 12 such that the nose 30 of the tab 26 extends over a proximal portion of the tear panel 20. The lift end 32 of the tab 26 is located opposite the tab nose 30 and provides access for a user to lift the lift end 32, such as with the user's finger, to force the nose 30 against the proximal portion of the tear panel 20.

When the tab nose 30 is forced against the tear panel 20, the score 22 initially ruptures at the vent region of the score 22 of the tear panel 20. This initial rupture of the score 22 is primarily caused by the lifting force on the tab resulting in lifting of a central region of the center panel, immediately adjacent the rivet 28, which causes separation of the residual metal of the score 22. The force required to rupture the score in the vent region, typically referred to as the "pop" force, is a lower degree of force relative to the force required to propagate other regions of the score 22 by continued lifting of the lift end 32 of the tab 26. Therefore, it is preferable for the panel 12 in the area around the rivet 28 only lifts enough to assist with initial score rupture, or "pop," and remains substantially stiff and flat to provide the needed leverage for the tab 26 to propagate the scoreline of the tear panel 20.

After the initial "pop", or venting of the tear panel, the user continues to lift the lift end 32 of the tab 26 which causes the tab nose 30 to be pushed downward on the tear panel 20 to continue the rupture of the score 22, as an opening force. As the opening operation is continued, the tear panel 20 is displaced downward and is rotated about the hinge region to be deflected into the container.

The downwardly extending wall or chuckwall 15 includes an inclined or curved upper wall portion 60 having an arcuate cross-sectional shape and is joined to the curl 14 through a concave bend relative to the public side 34. The chuckwall 15 has an inclined lower wall portion 64 which is joined directly to the strengthening member 16, in this case a generally U-shaped countersink. An outer wall 68 of the countersink and the lower wall portion 64 of the chuckwall 15 extend at an angle.

An inner wall 72 of the countersink extends upwardly and angles slightly radially inwardly less than 10°. The inner wall 72 is joined to the center panel 12 through a circumferential panel which has convex bend or lower panel radius 76 joined to another convex bend or upper panel radius 80 by a short wall 84. The upper panel radius 80 is located radially inwardly relative to the center axis 50 from the lower panel radius 76. The circumferential panel has a lowermost point and an uppermost point wherein an angle φ of a straight line drawn from the lowermost point to the uppermost point is between 15° and 75°, more preferably 30° to 60°, and most preferably about 45° as measured from a vertical axis. A segment of the circumferential panel, preferably on the short wall 84, lies on the straight line.

Figure 5:
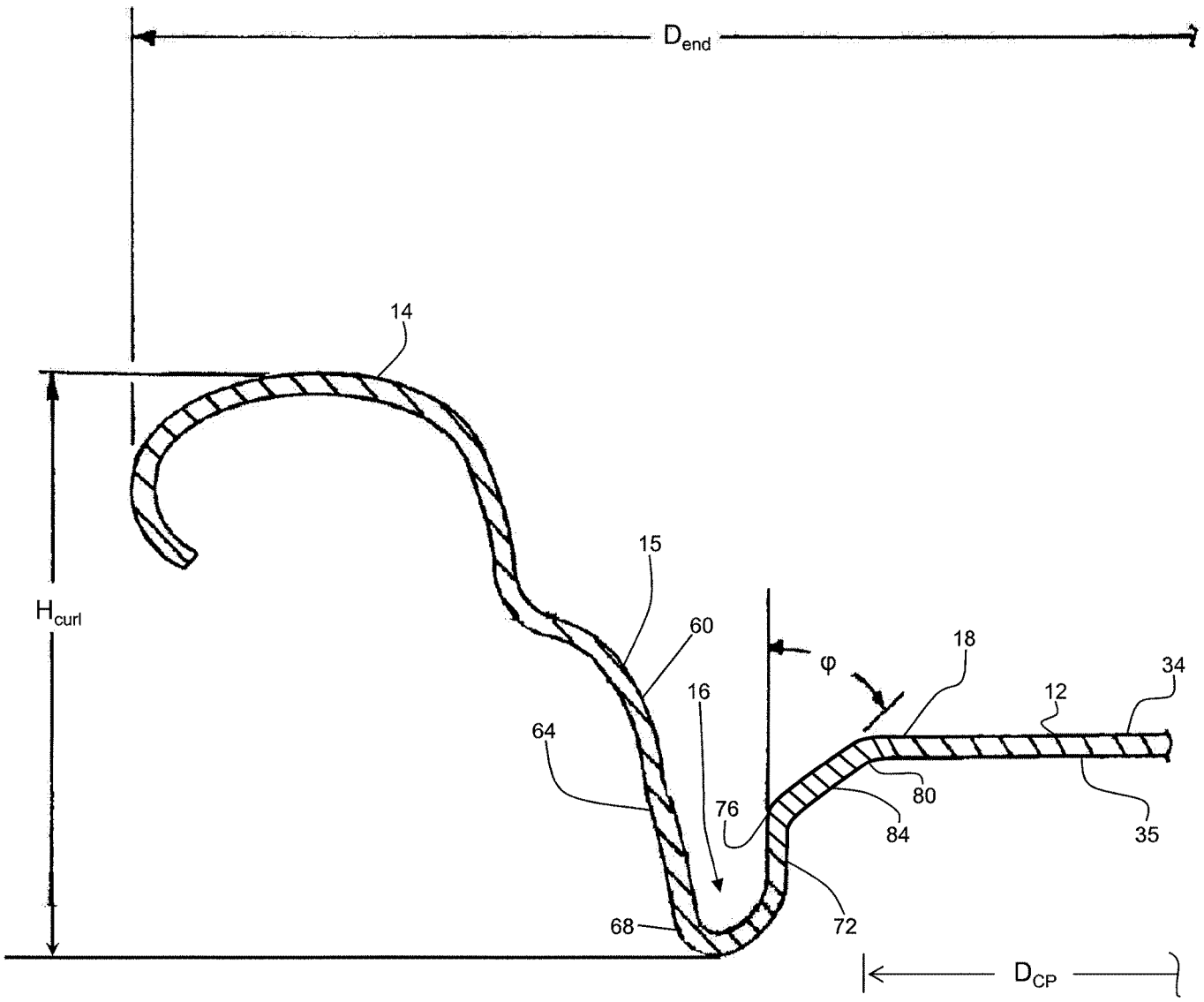
FIG. 5 is a partial cross-sectional view of a can end, shell or converted can end illustrating one aspect of the present invention, namely a reformed inner wall of a U-shaped countersink having an increased length/height and a reduced angle.
Figure 6:
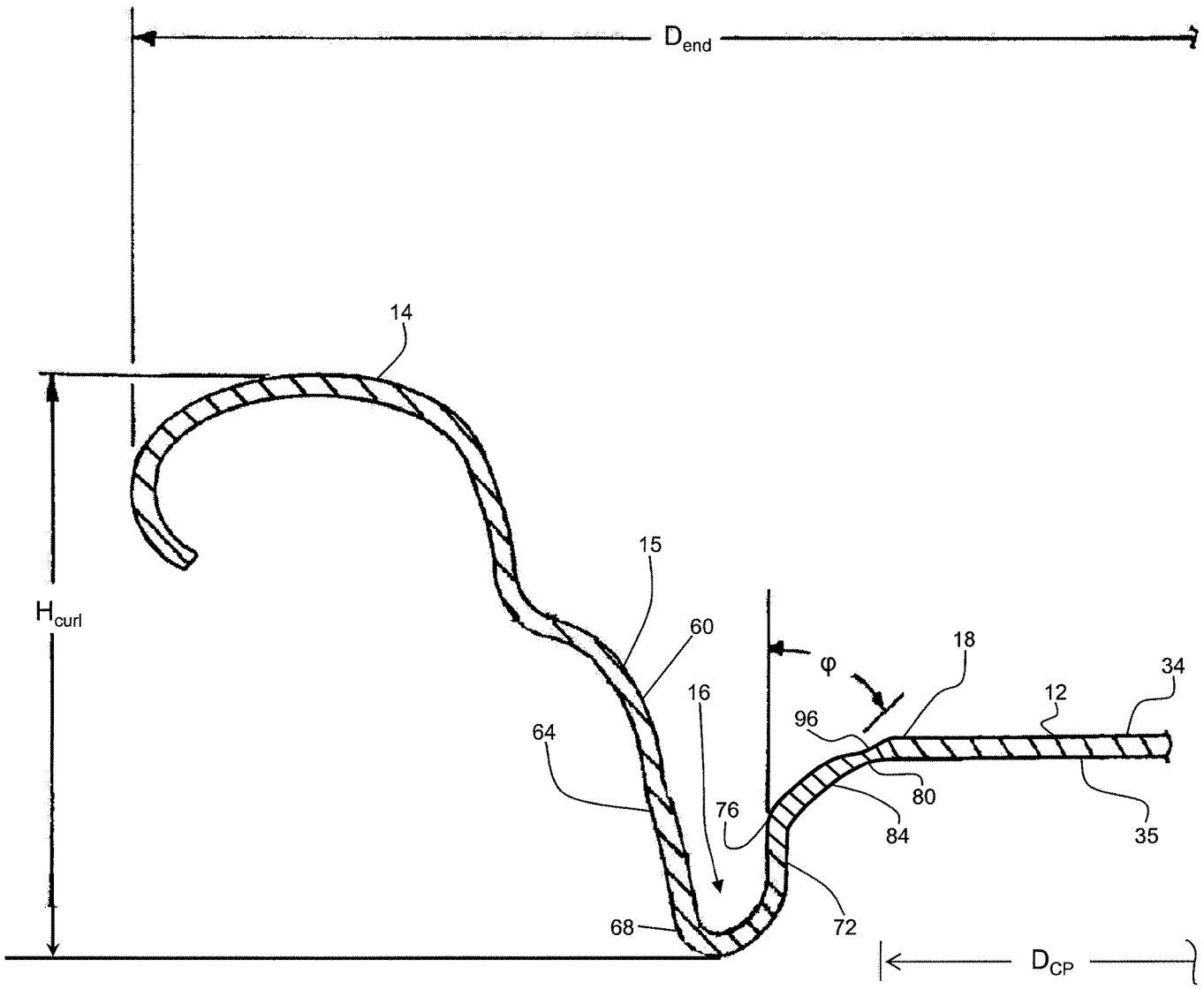
FIG. 6 is a partial cross-sectional view of a can end, shell or converted can end illustrating one aspect of the present invention, namely a reformed inner wall of a U-shaped countersink having an increased length/height and a reduced angle and a feature formed in a circumferential panel comprising a coined segment of the circumferential panel.
Figure 7:
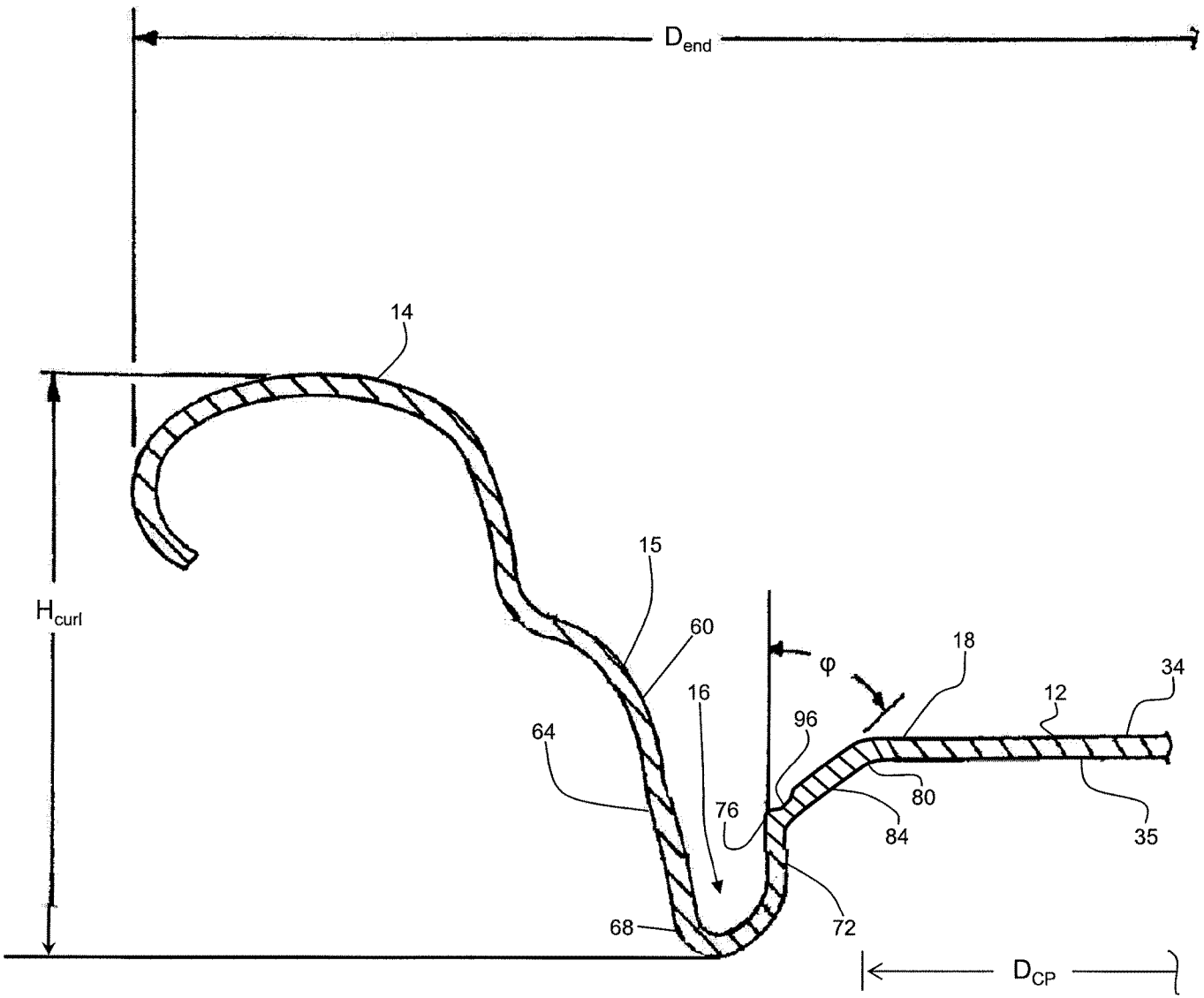
FIG. 7 is a partial cross-sectional view of a can end, shell or converted can end illustrating one aspect of the present invention, namely a reformed inner wall of a U-shaped countersink having an increased length/height and a reduced angle and a feature formed in a circumferential panel comprising a coined segment of the circumferential panel in an alternate position relative to the can end of FIG. 6.
Figure 8:
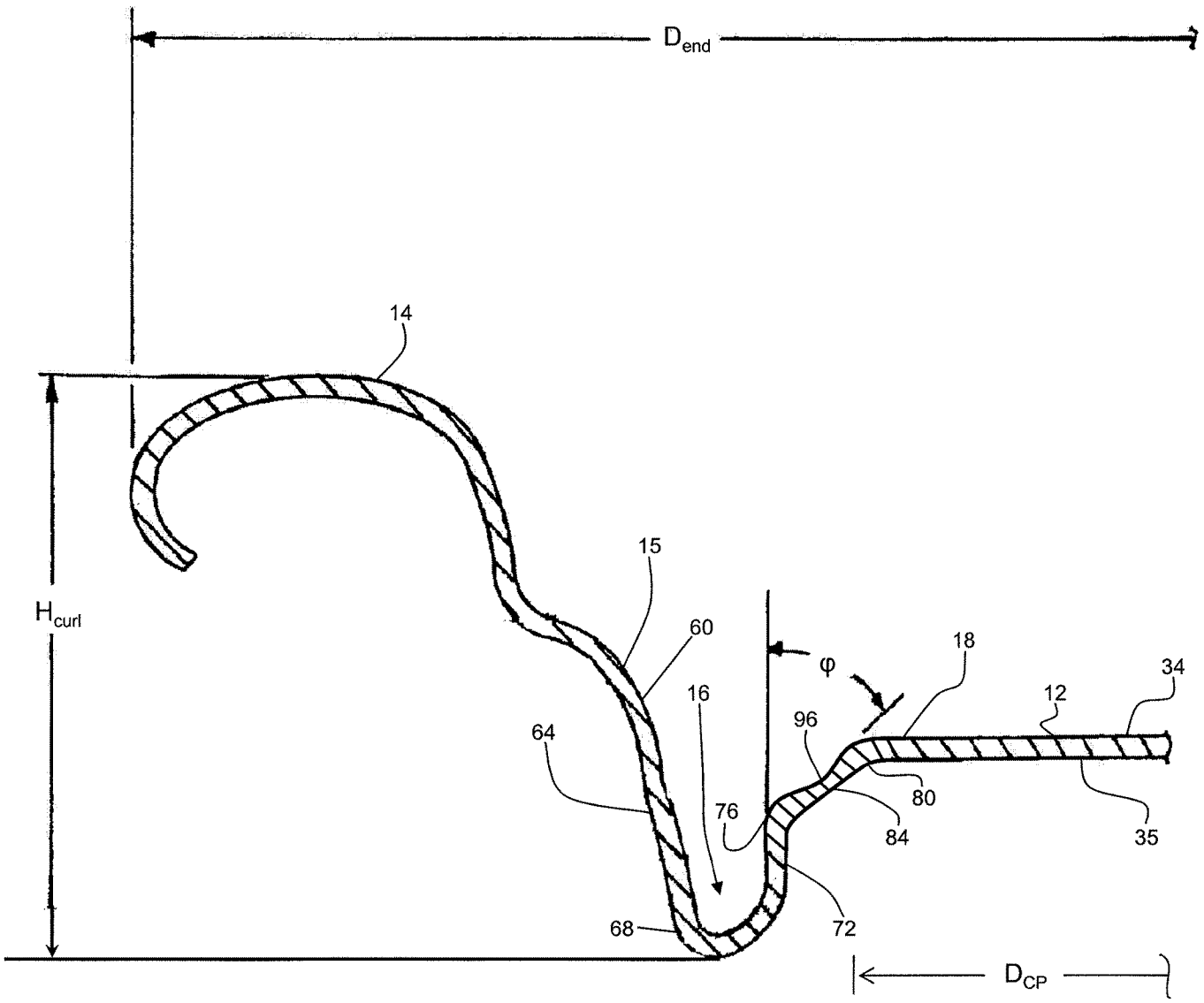
FIG. 8 is a partial cross-sectional view of a can end, shell or converted can end illustrating one aspect of the present invention, namely a reformed inner wall of a U-shaped countersink having an increased length/height and a reduced angle and a feature formed in a circumferential panel comprising a coined segment of the circumferential panel in an alternate position relative to the can ends of FIGS. 6 and 7.
Figure 9:
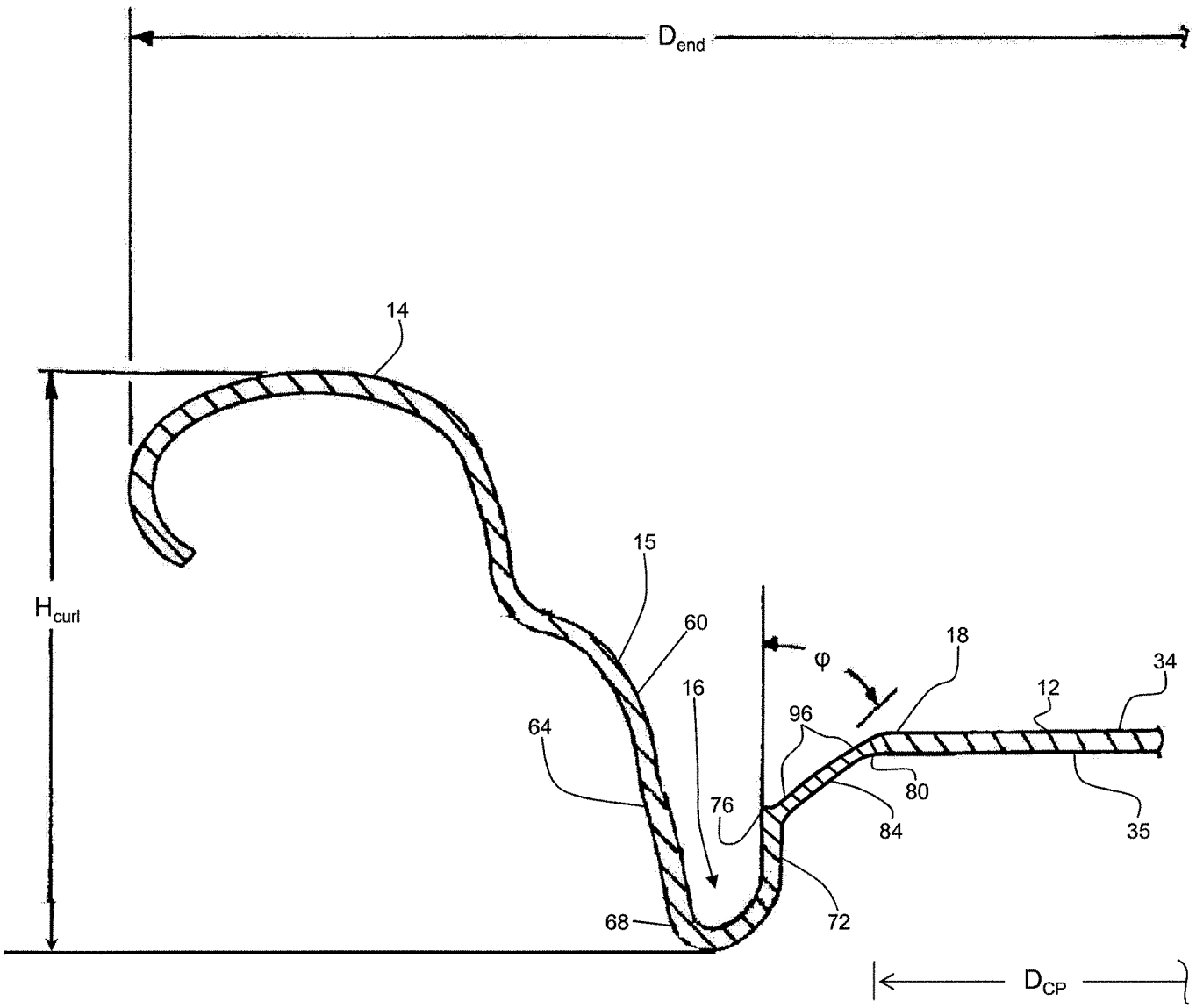
FIG. 9 is a partial cross-sectional view of a can end, shell or converted can end illustrating one aspect of the present invention, namely a reformed inner wall of a U-shaped countersink having an increased length/height and a reduced angle and a feature formed in a circumferential panel comprising a coined segment of the circumferential panel in an alternate position relative to the can ends of FIGS. 6-8.
Figure 10:
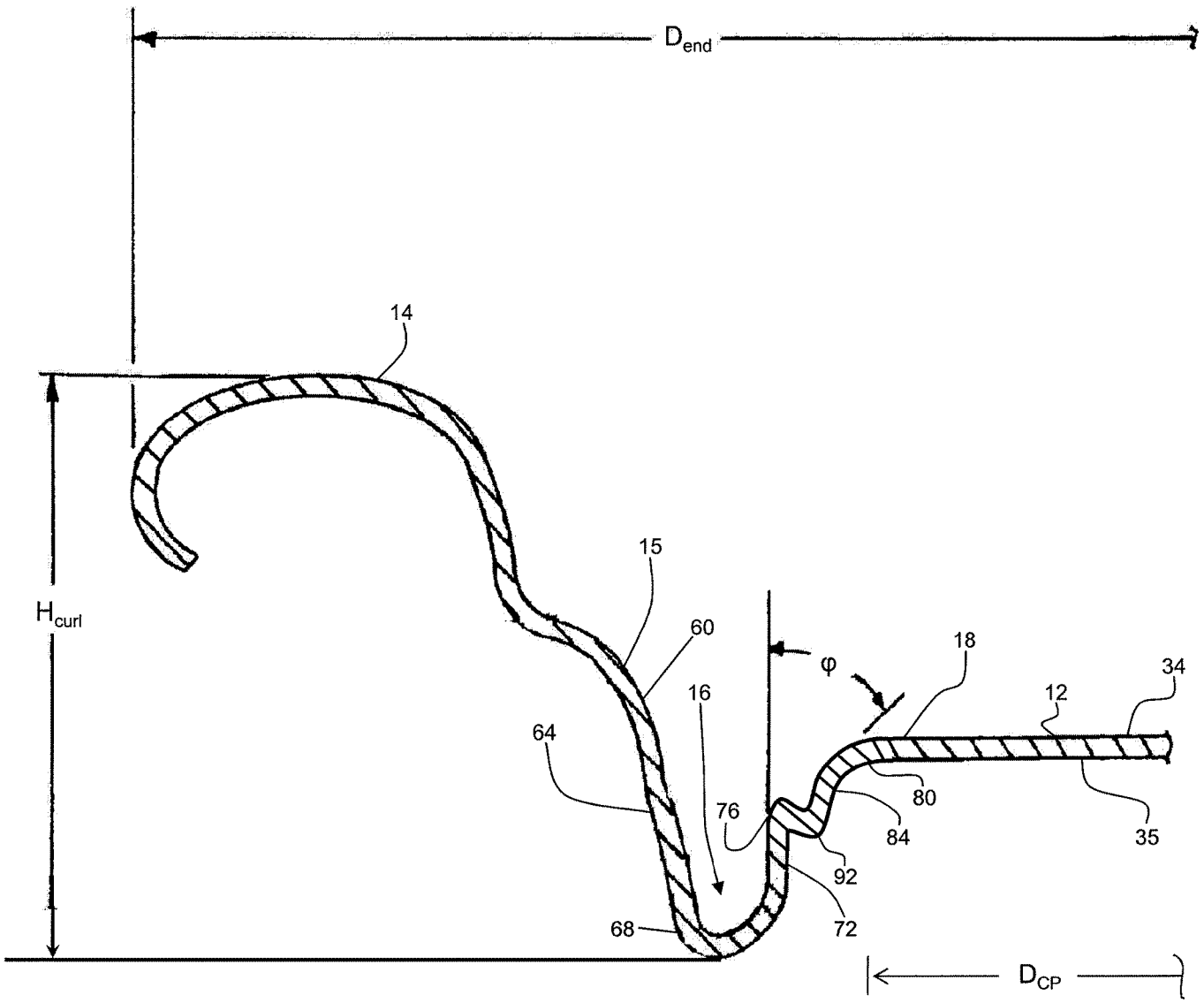
FIG. 10 is a partial cross-sectional view of a can end, shell or converted can end illustrating one aspect of the present invention, namely a reformed inner wall of a U-shaped countersink having an increased length/height and a reduced angle and a feature formed in a circumferential panel comprising a bead formed in the circumferential panel.
Figure 11:
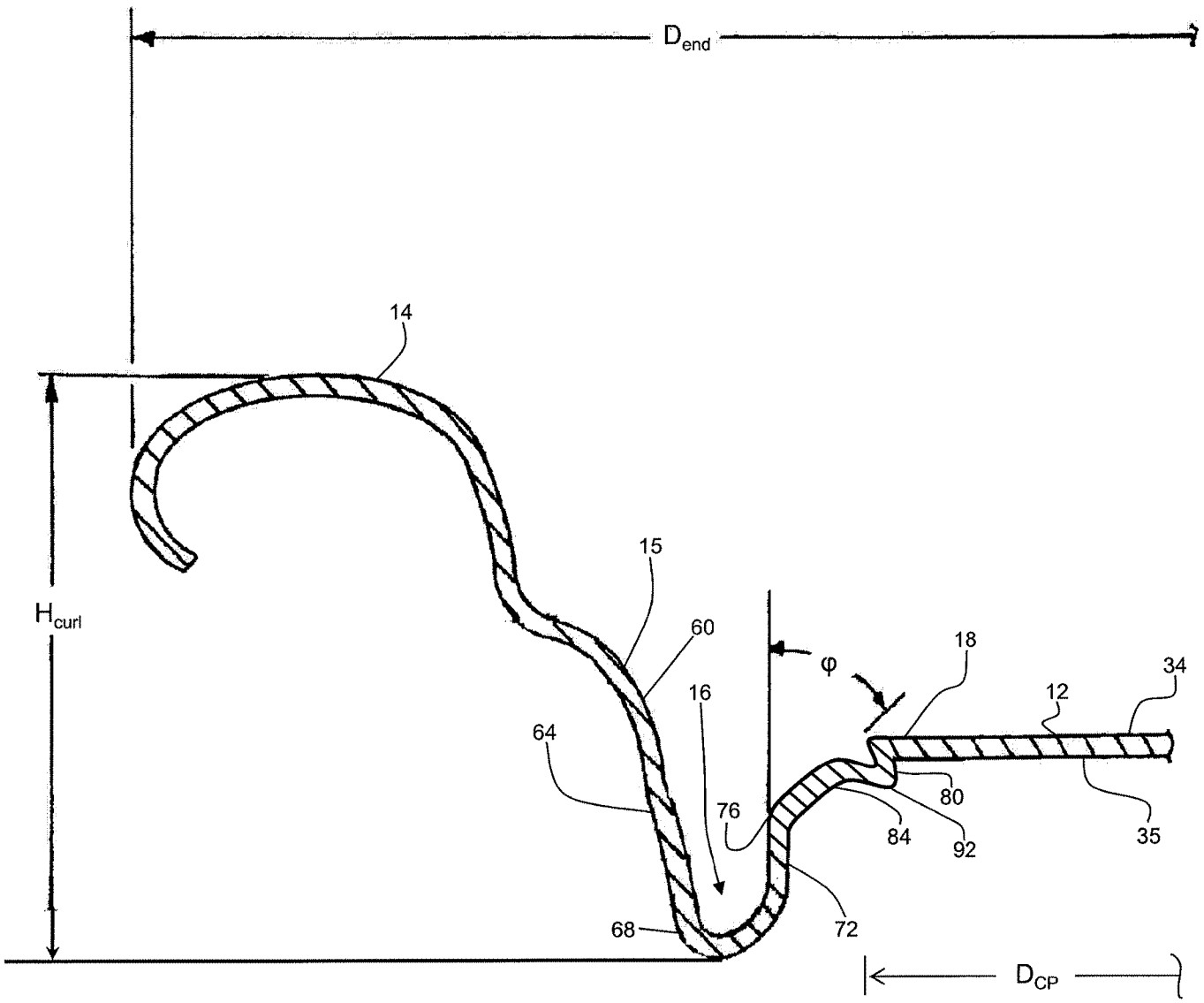
FIG. 11 is a partial cross-sectional view of a can end, shell or converted can end illustrating one aspect of the present invention, namely a reformed inner wall of a U-shaped countersink having an increased length/height and a reduced angle and a feature formed in a circumferential panel comprising a bead formed in the circumferential panel in an alternate position relative to the can end of FIG. 10.
Figure 12:
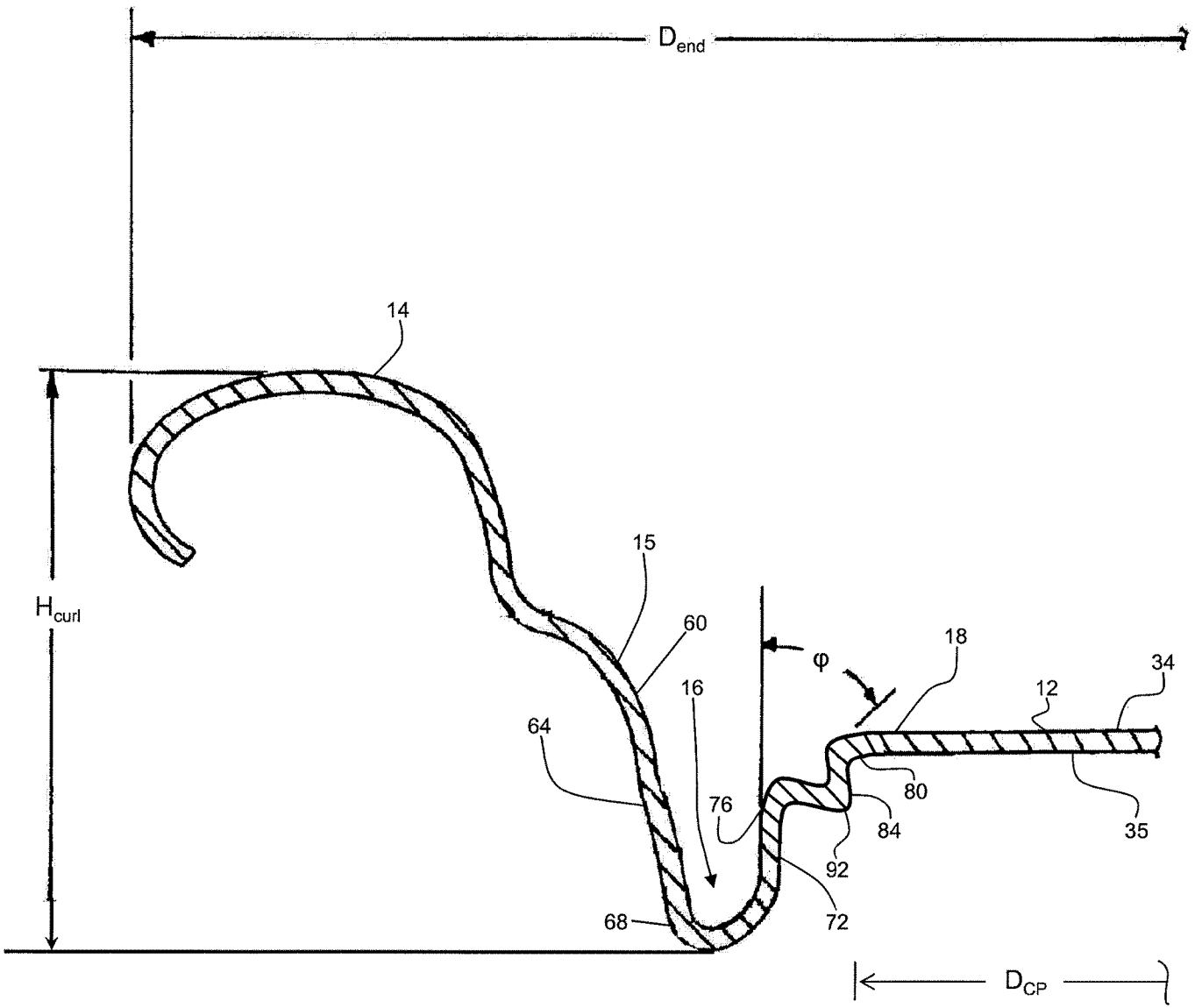
FIG. 12 is a partial cross-sectional view of a can end, shell or converted can end illustrating one aspect of the present invention, namely a reformed inner wall of a U-shaped countersink having an increased length/height and a reduced angle and a feature formed in a circumferential panel comprising a bead formed in the circumferential panel in an alternate position relative to the can ends of FIGS. 10 and 11.
Figure 13:
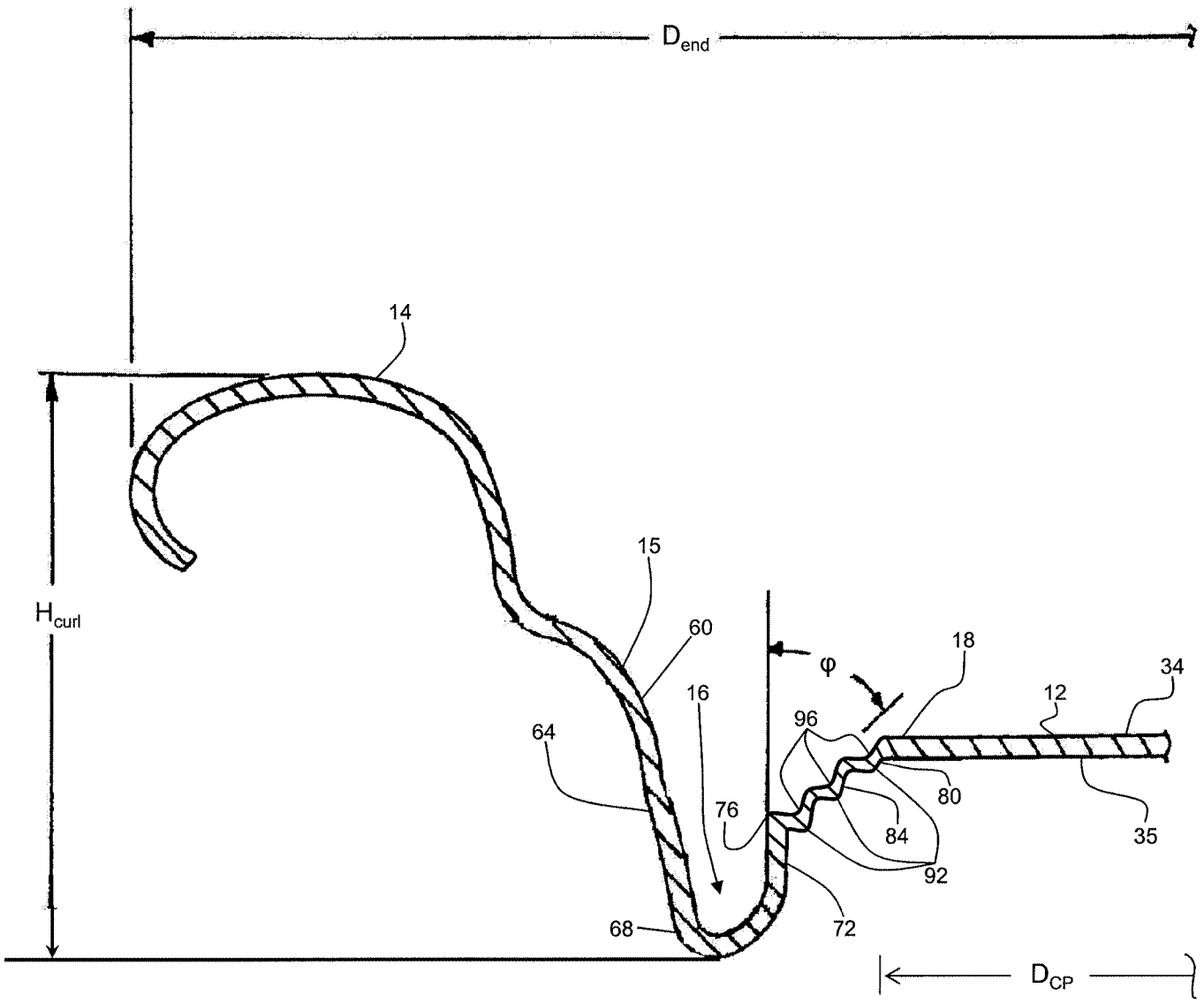
FIG. 13 is a partial cross-sectional view of a can end, shell or converted can end illustrating one aspect of the present invention, namely a reformed inner wall of a U-shaped countersink having an increased length/height and a reduced angle and a plurality of features formed in a circumferential panel comprising coined segments and beads formed in the circumferential panel.
Figure 14:
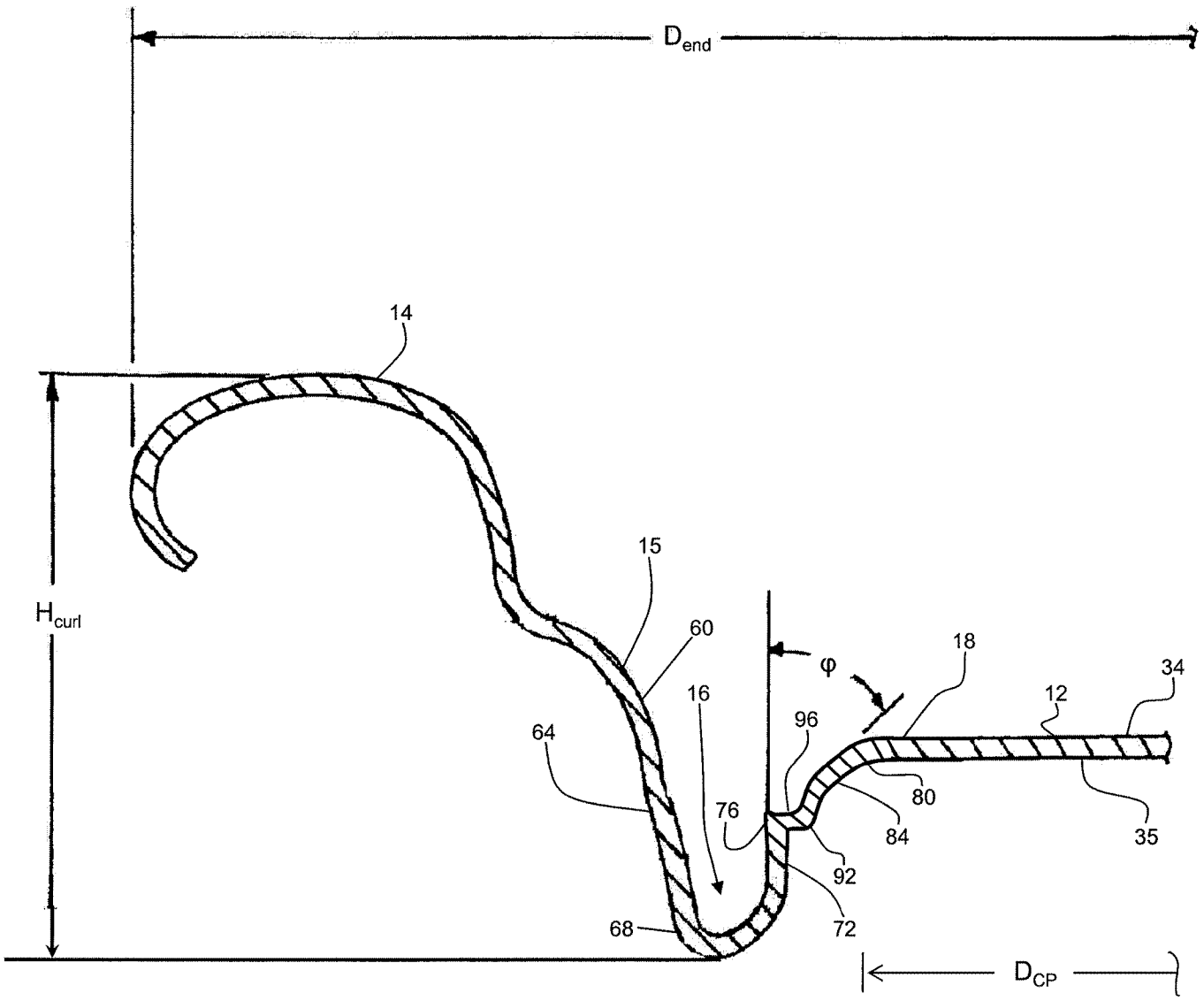
FIG. 14 is a partial cross-sectional view of a can end, shell or converted can end illustrating one aspect of the present invention, namely a reformed inner wall of a U-shaped countersink having an increased length/height and a reduced angle and a plurality of features formed in a circumferential panel comprising a coined segment and a bead formed in the circumferential panel.
Figure 15:
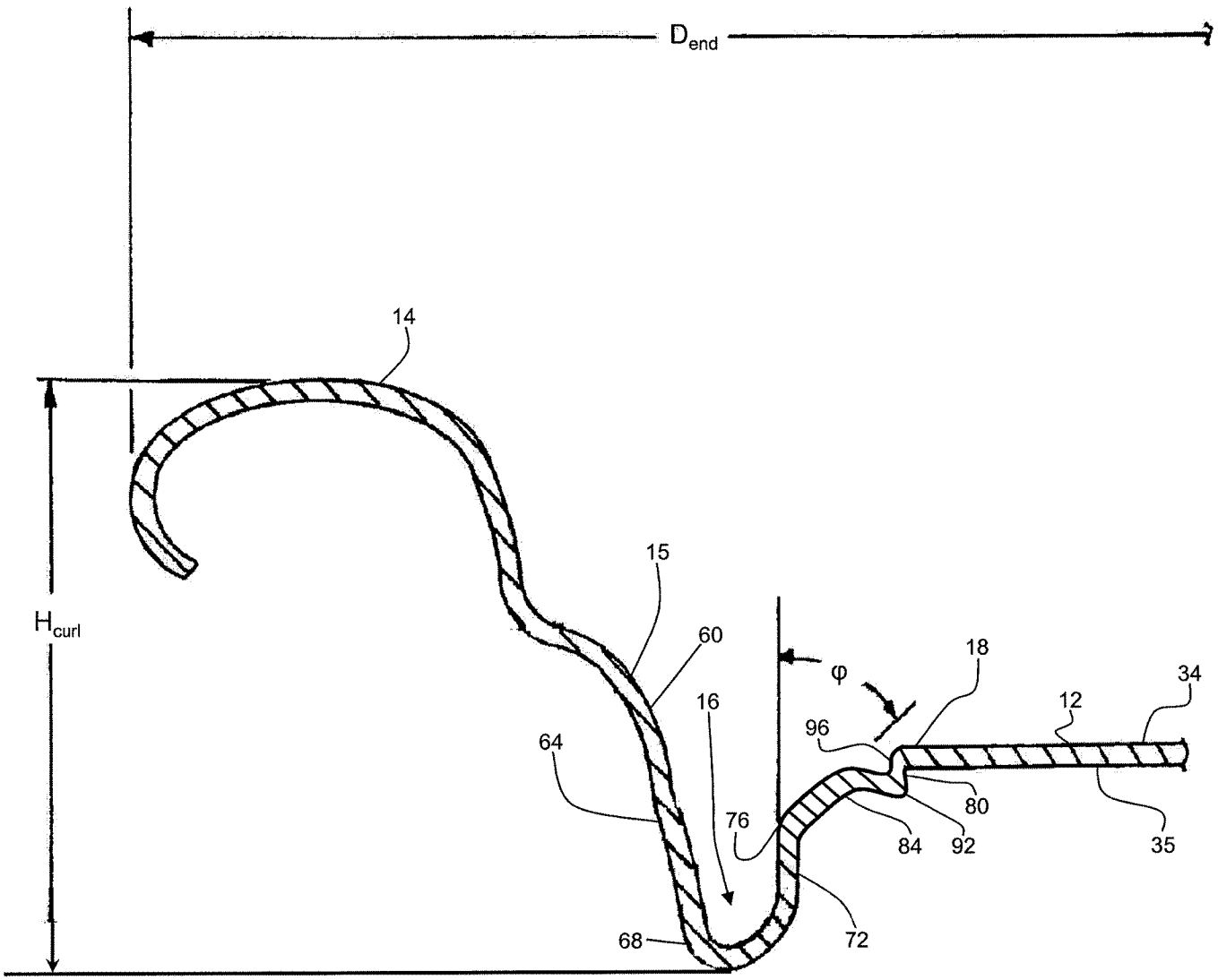
FIG. 15 is a partial cross-sectional view of a can end, shell or converted can end illustrating one aspect of the present invention, namely a reformed inner wall of a U-shaped countersink having an increased length/height and a reduced angle and a plurality of features formed in a circumferential panel comprising a coined segment and a bead formed in the circumferential panel in alternate positions relative to the can end of FIG. 14.
Figure 16:
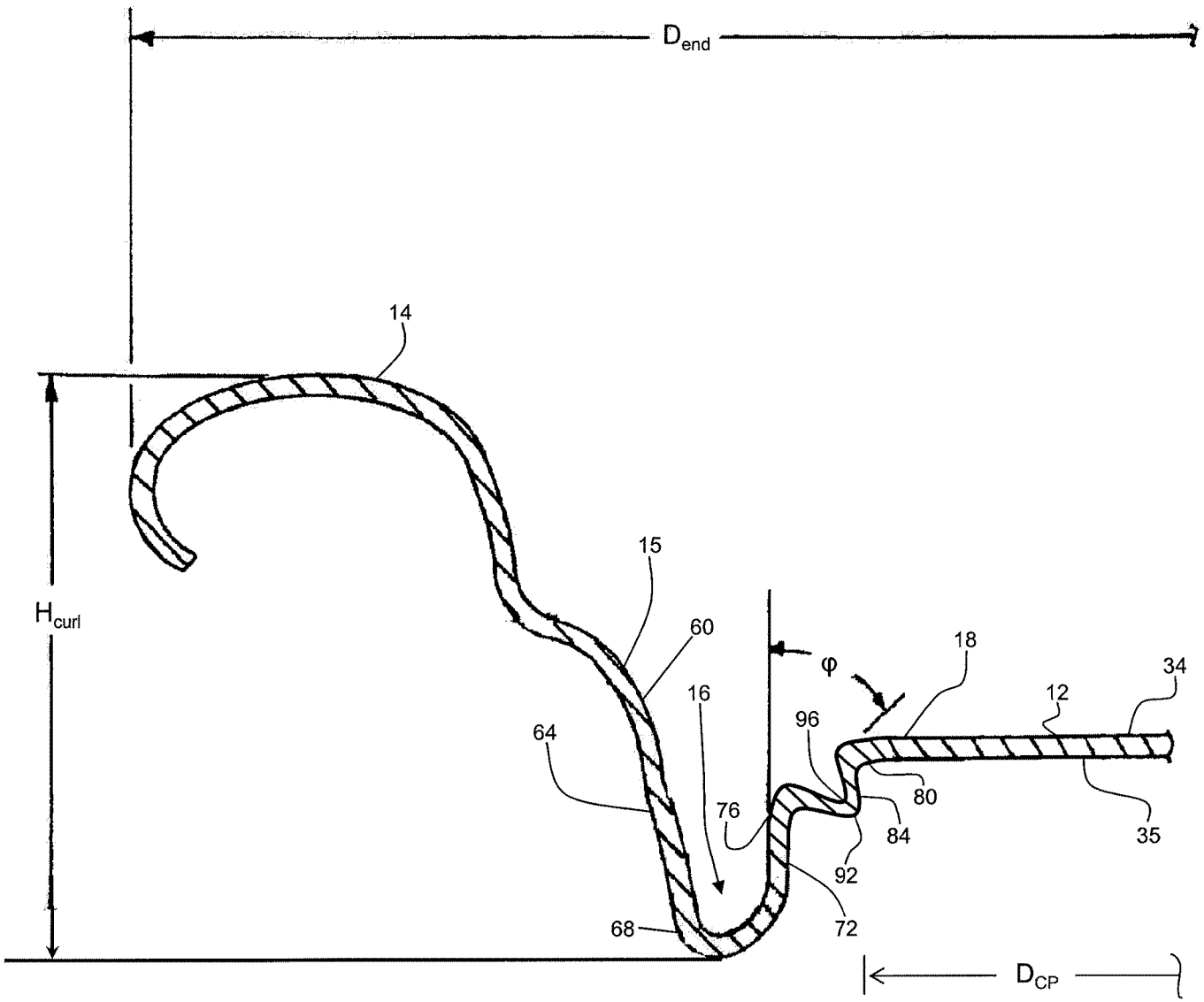
FIG. 16 is a partial cross-sectional view of a can end, shell or converted can end illustrating one aspect of the present invention, namely a reformed inner wall of a U-shaped countersink having an increased length/height and a reduced angle and a plurality of features formed in a circumferential panel comprising a coined segment and a bead formed in the circumferential panel in alternate positions relative to the can ends of FIGS. 14 and 15.
Figure 17:
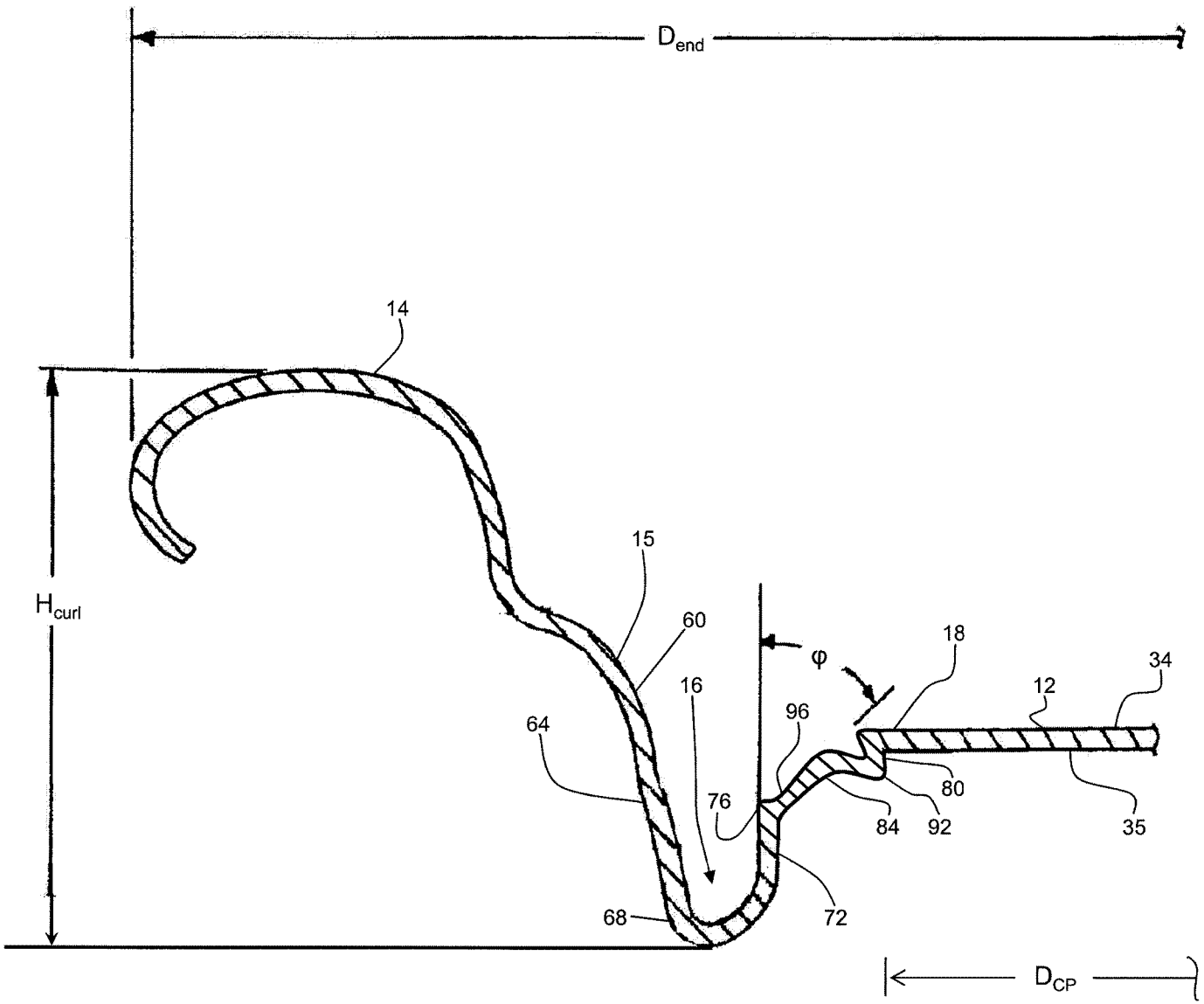
FIG. 17 is a partial cross-sectional view of a can end, shell or converted can end illustrating one aspect of the present invention, namely a reformed inner wall of a U-shaped countersink having an increased length/height and a reduced angle and a plurality of features formed in a circumferential panel comprising a coined segment and a bead formed in the circumferential panel in separate, discrete locations of the circumferential panel.
Figure 18:
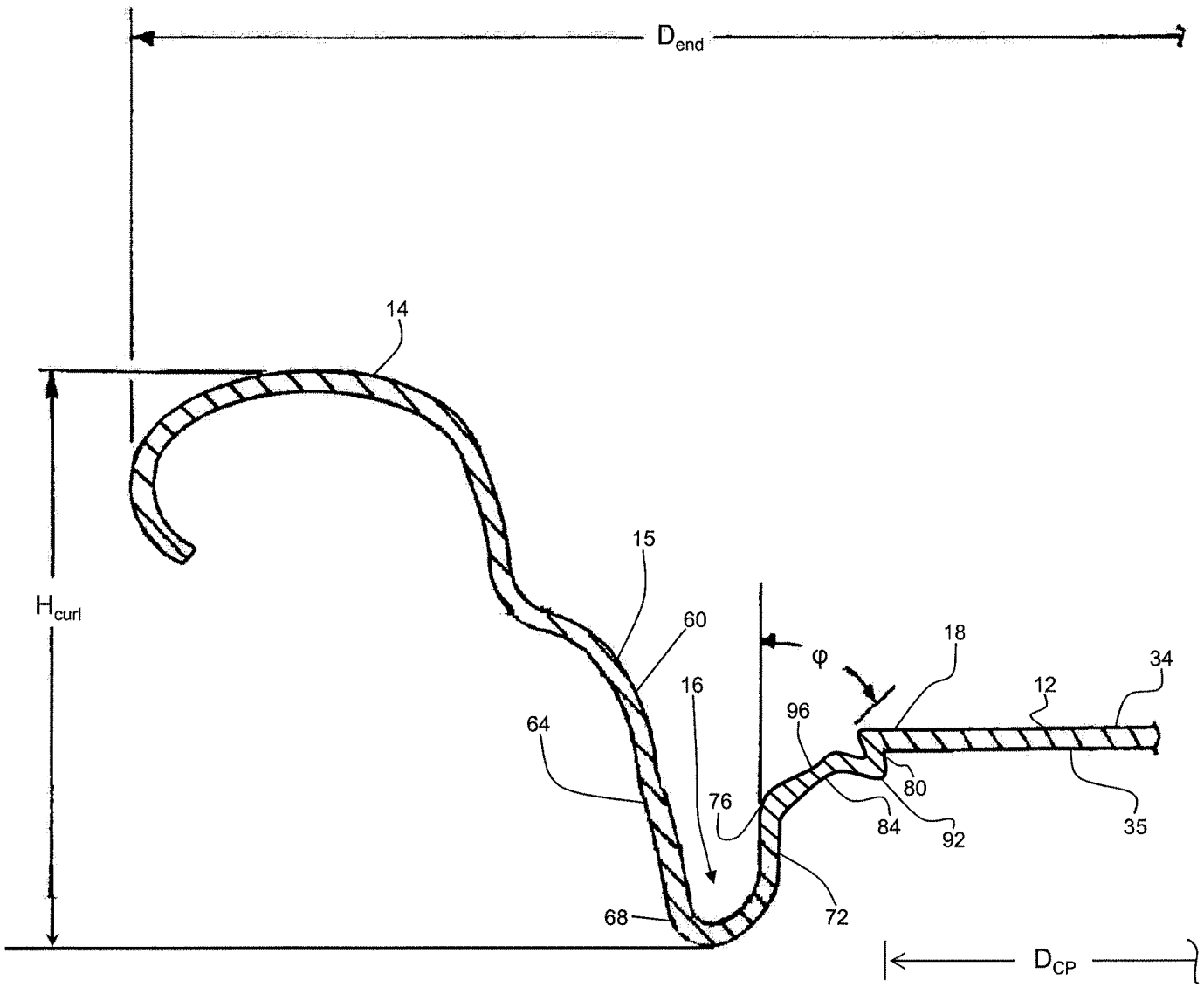
FIG. 18 is a partial cross-sectional view of a can end, shell or converted can end illustrating one aspect of the present invention, namely a reformed inner wall of a U-shaped countersink having an increased length/height and a reduced angle and a plurality of features formed in a circumferential panel comprising a coined segment and a bead formed in the circumferential panel in separate, discrete locations of the circumferential panel and in alternate positions relative to the can end of FIG. 17.
Figure 19:
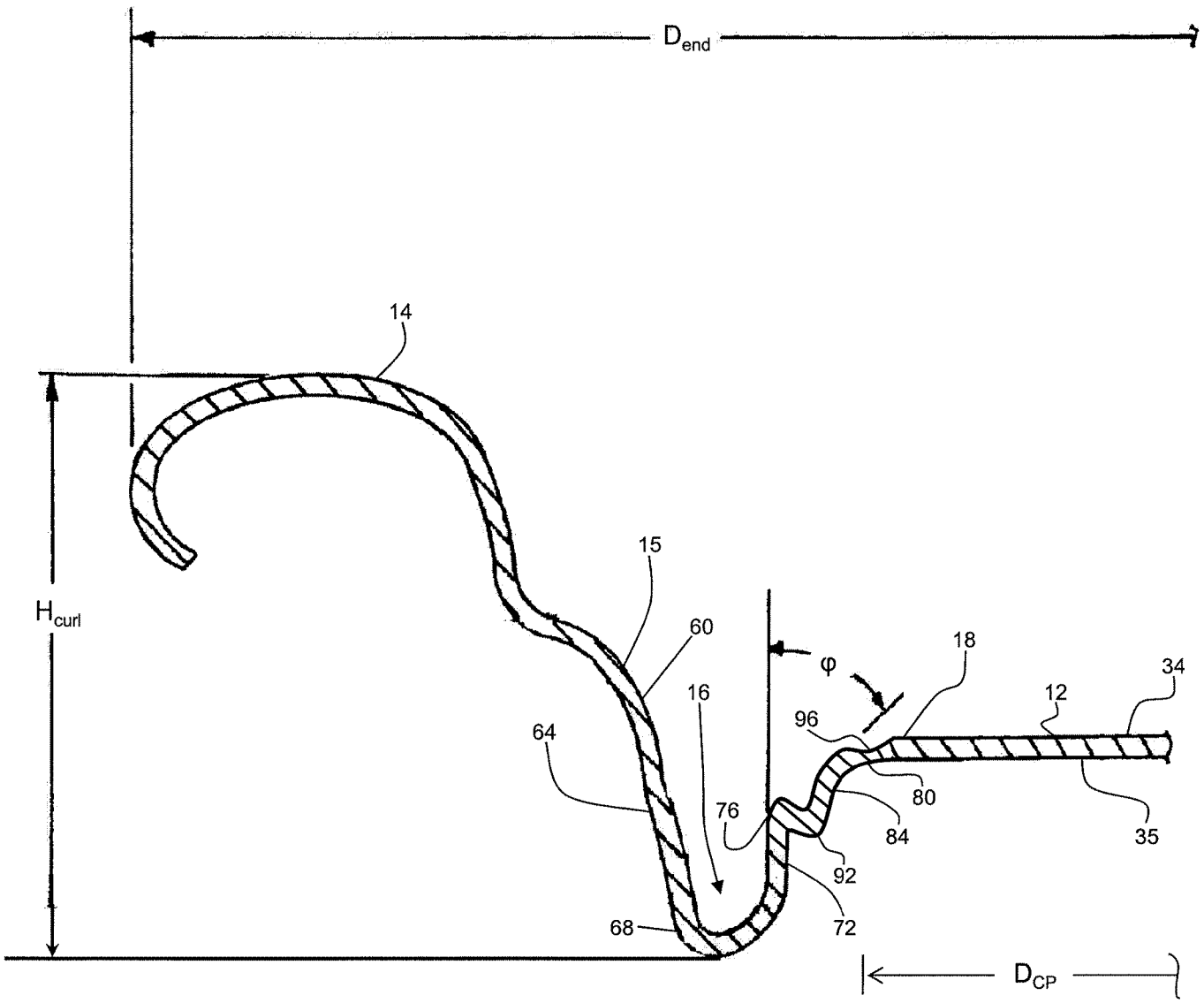
FIG. 19 is a partial cross-sectional view of a can end, shell or converted can end illustrating one aspect of the present invention, namely a reformed inner wall of a U-shaped countersink having an increased length/height and a reduced angle and a plurality of features formed in a circumferential panel comprising a plurality of coined segments and a bead formed in separate, discrete locations of the circumferential panel.
Figure 20:
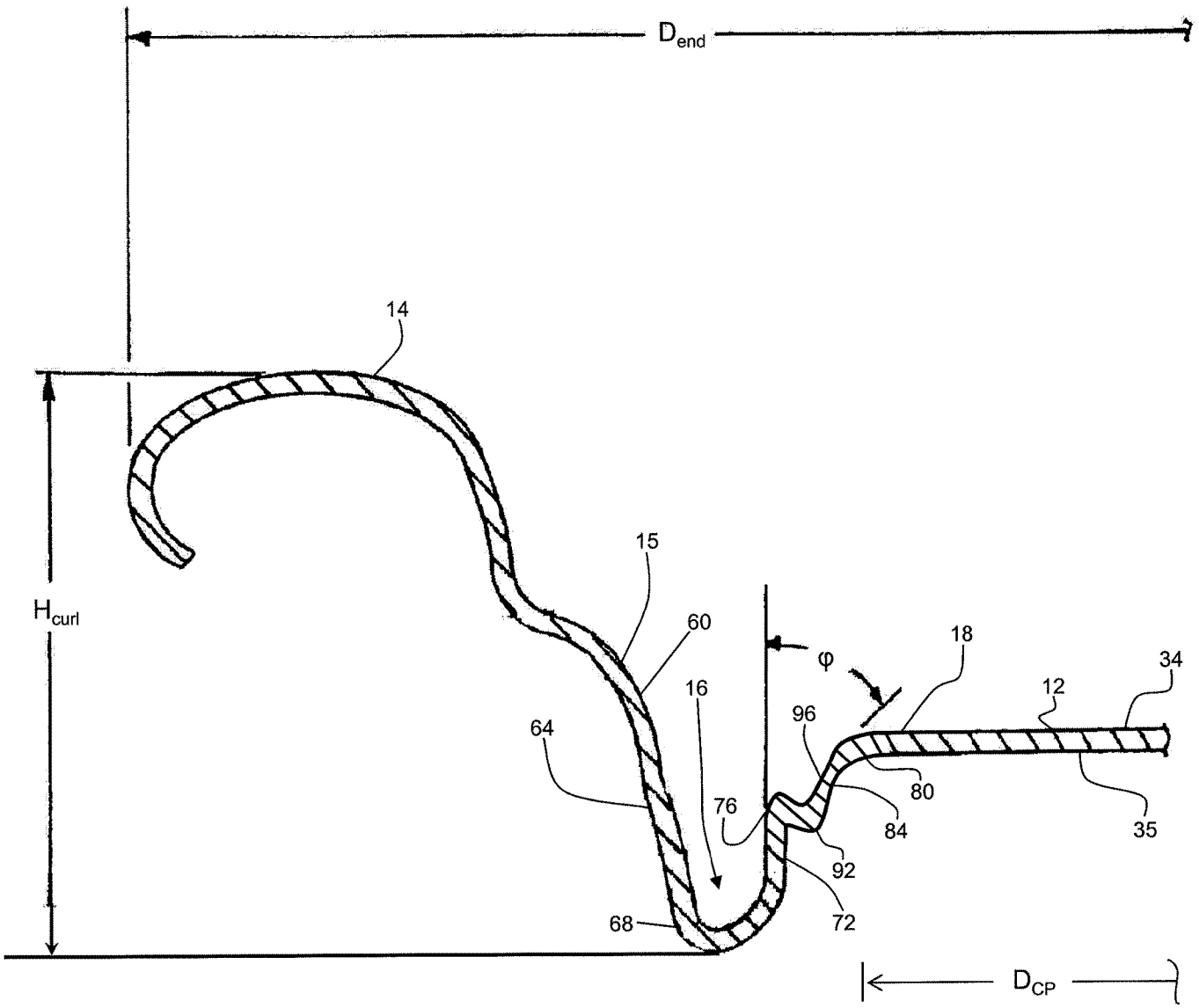
FIG. 20 is a partial cross-sectional view of a can end, shell or converted can end illustrating one aspect of the present invention, namely a reformed inner wall of a U-shaped countersink having an increased length/height and a reduced angle and a plurality of features formed in a circumferential panel comprising a coined segment and a bead formed in the circumferential panel in separate, discrete locations of the circumferential panel.
Figure 21:
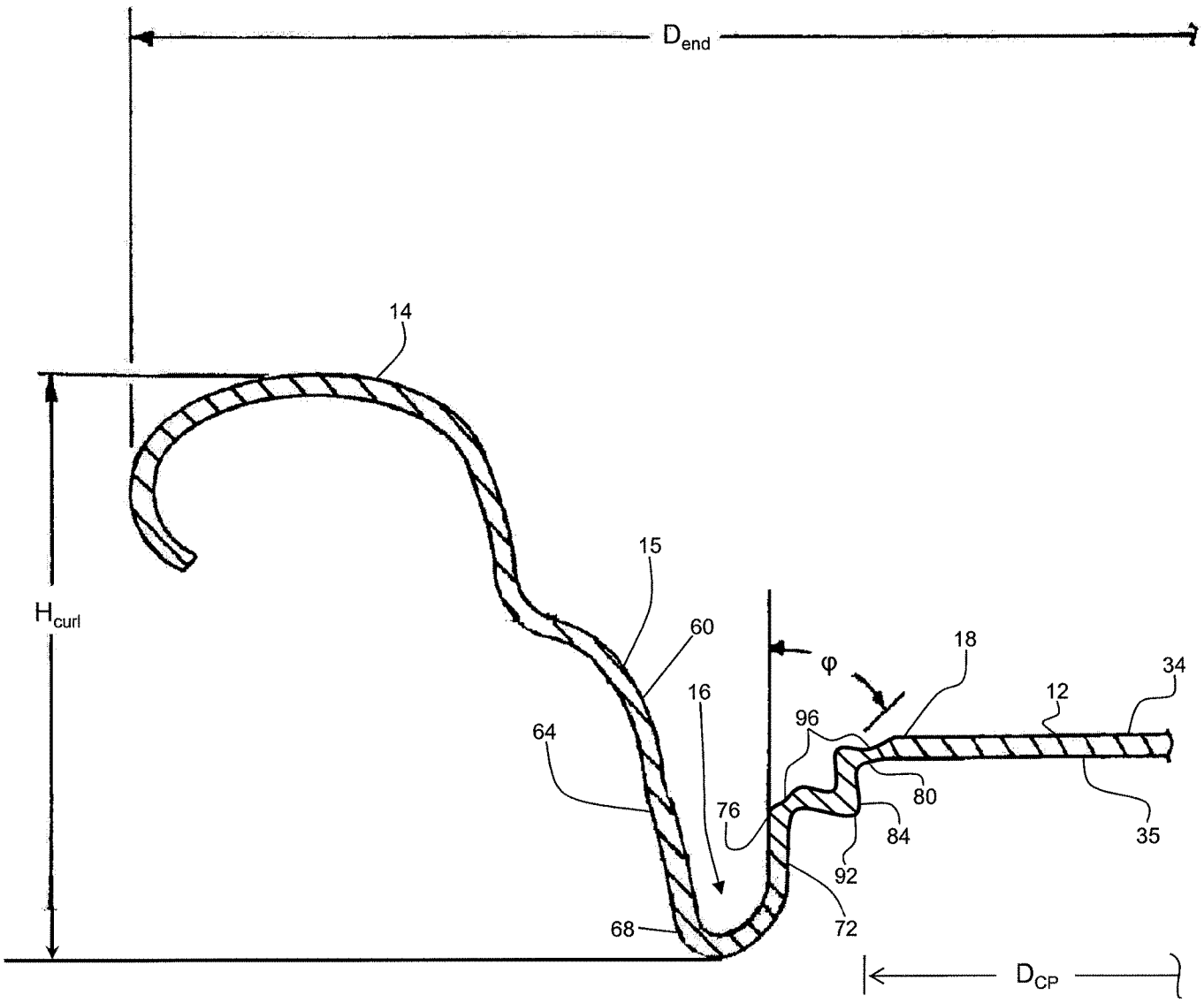
FIG. 21 is a partial cross-sectional view of a can end, shell or converted can end illustrating one aspect of the present invention, namely a reformed inner wall of a U-shaped countersink having an increased length/height and a reduced angle and a plurality of features formed in a circumferential panel comprising a plurality of coined segments and a bead formed in the circumferential panel in separate, discrete locations of the circumferential panel.
Figure 22:
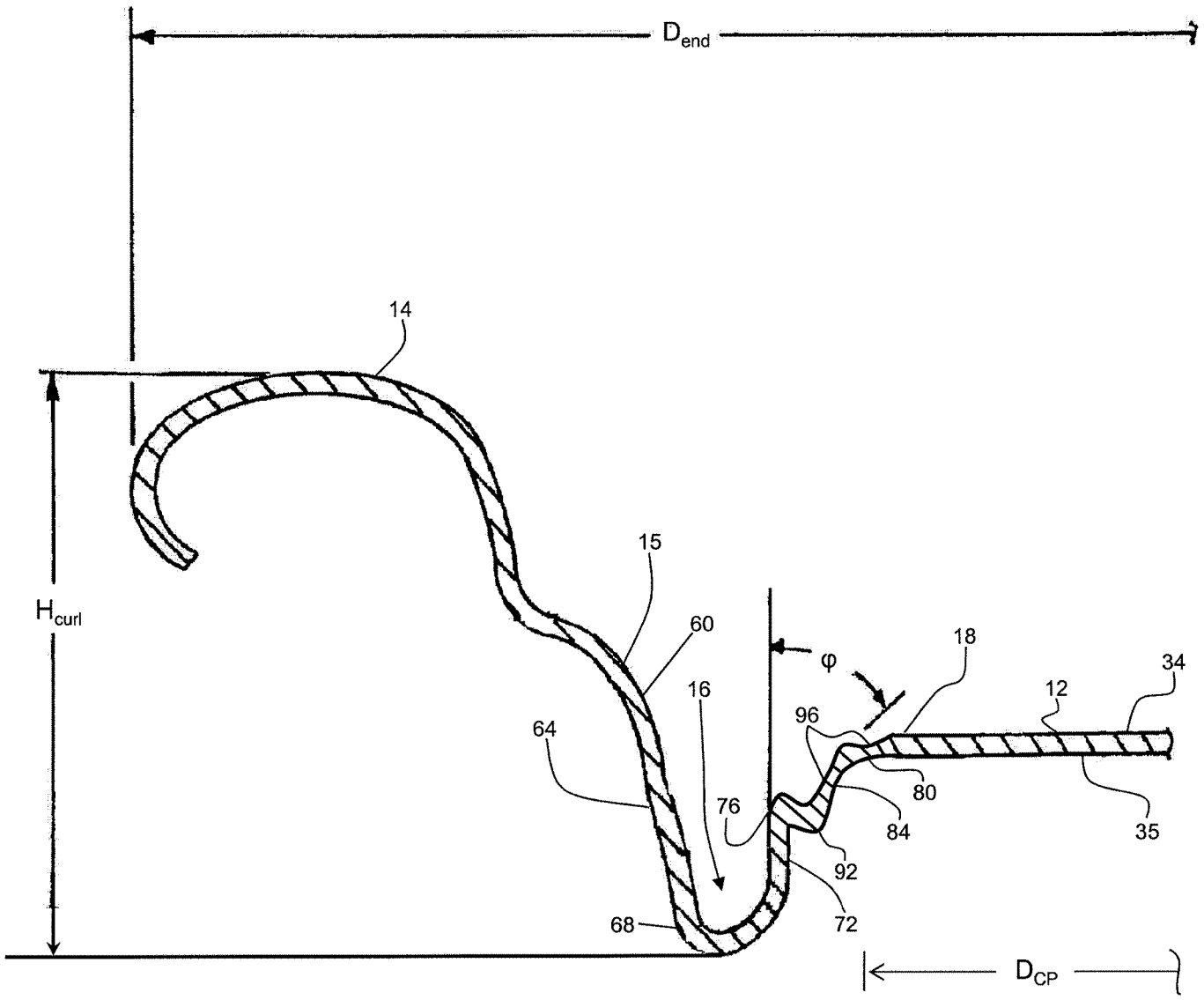
FIG. 22 is a partial cross-sectional view of a can end, shell or converted can end illustrating one aspect of the present invention, namely a reformed inner wall of a U-shaped countersink having an increased length/height and a reduced angle and a plurality of features formed in a circumferential panel comprising a plurality of coined segments and a bead formed in separate, discrete locations of the circumferential panel.

The features described in the following paragraphs primarily contribute to the strength of the can end by allowing a diameter Du of the center panel 12 to be increased via reforming and/or allowing for increasing a length/height of the inner wall 72 of the countersink and/or decreasing the angle of the inner wall 72 as measured from a vertical axis as illustrated in FIG. 5, preferably about 5° as measured from a vertical axis, more preferably substantially vertical. Expanding or increasing the diameter $D_{CP}$ of the center panel 12 generally results in an increased center panel height, a more vertical inner wall 72, and a tighter panel radius. It also work hardens the panel radius. A longer and more vertical inner wall 72 leads to better buckle performance. However, the inner wall 72 must exhibit at least some angle from the vertical in order for a fully formed can end to be removed from the tooling used to form the can end. Absent some angle, the can end will bind to lower tooling, which would adversely affect manufacturing of the can end.

Referring to FIGS. 6-22, the circumferential panel includes one or more features which directly and/or indirectly improve can end performance relative to resistance to buckle or buckle strength and/or tab-over-chime. These features are generally deformations, such as coined segments (i.e. metal compressed between two tools to produce a locally cold worked segment of metal having a locally reduced thickness produced from the compression), convex or concave beading (i.e. a curvilinear deformation produced between a convex-shaped tool and a concave-shaped tool), and/or bending to produce a convex or concave bend structure relative to the public side 34. The features can be located on the lower panel radius 76, the upper panel radius 80, and/or the short wall 84. Generally, any coining operation takes place on one or both of the lower panel radius 76 and the upper panel radius 80, although the short wall 84 may also be subjected to a coining operation, whereby any portion of the circumferential panel may be coined.

As set forth in the preceding paragraph, the circumferential panel has one or more features formed therein. The features may provide locally additional material from the thickness of can end or other volumetric dimensions of the can end from which to form a substantially vertical, radially inner wall 72 of the countersink 16 having a sufficient length/height wherein the can end exhibits a buckle strength greater than or equal to 100 psi. Again, these features may be formed within the shell-making process or during conversion of a can end shell 100 to a finished can end 10.

A bead 92 may be formed in the circumferential panel. A bead is a formation in the can end wherein deformation of the public side 34 and the product side 35 are substantially uniform, such that the public side 34 and the product side 35 remain substantially parallel throughout the bead structure. The bead 92 illustrated is concave relative to the public side 34 but may be convex relative to the public side 34 if desired. The bead 92 may be formed at a junction between the lower panel radius 76 and the short wall 84, a junction between the upper panel radius 80 and the short wall 84, and/or on the short wall 84 between the junctions with the upper panel radius 80 and the lower panel radius 76. The bead 92 generally has an arcuate shape in cross-section, although it can take virtually any other shape without departing from the spirit of the invention. Thus, the circumferential panel may include the lower panel radius 74 separated from an upper panel radius 78 by a generally upwardly and inwardly extending short wall 84, which has a first segment extending radially inwardly relative to the center axis, a second segment comprising a concave bend relative to the public side, and a third segment extending upwardly and radially outwardly relative to the center axis 50.

However, different locations of the bead 92 may cause or result in various other structural formations and orientations in the circumferential panel. For example, a convex bend relative to the public side may be located between the bead 92 and the lower panel radius 76. Additionally, a convex bend relative to the public side may be located between the bead 92 and the upper panel radius 80. Thus, the bead 92 may have a segment extending radially inwardly relative to the center axis 50 and downwardly from a radially innermost portion of the lower panel radius 76. Alternatively, or additionally, the bead 92 may have a segment extending downwardly and radially inwardly relative to a radially outermost portion the upper panel radius 80. These varying orientations depend on the location, depth, and direction of the bead 92 as illustrated in the drawings.

Still further, the circumferential panel may include one or more coined segments 96. Coining is a compression of the material between two tools. As a result of coining, there will be a localized cold worked segment of the can end having a thickness less than surrounding portions of the can end. This localized thinning results in additional material from which to lengthen or increase the height of the inner wall 72 of the countersink, decrease the angle of the countersink, and/or increase the diameter of the center panel 12. A first coined segment 96 may be located on the lower panel radius 76, the upper panel radius 80, or the short wall 84. An additional coined segment 96 may be located on one of the remaining sections of the circumferential panel, and another additional coined segment 96 may be located on the last remaining section of the circumferential panel.

The features described above allow a can end 10 to be down-gauged or produced from a thinner metal blank, less than 0.0082 inches (0.2083 mm), preferably less than or equal to 0.0080 inches (0.2032 mm), with the diameter of the metal blank remaining constant and a diameter $D_{end}$ and a curl height $H_{curl}$ of the finished end also remaining constant while a diameter Du of the center panel may be expanded from the can end shell 100 to the finished converted can end 10. In other words, the metal saving is achieved at the expense of the thickness of the metal blank from which the blank is formed and the thickness of the material in the resultant finished can end 10, rather than at the expense of the other dimensions. Thus, modifications to the can body to which the end is eventually seamed would not need to be changed nor would the tooling used to seam the end to the can body need to be changed. This is very advantageous because such design changes to the can body would be costly and time consuming as would modifications to the method of seaming the can end to a can body.

Preferably speaking, the features described above are formed during the conversion process. Performed in the conversion press, this invention reduces can end countersink dimensional variation by reforming the countersink 16 during the conversion press operation. This leads to improved double seam to can bodies by reducing variation (i.e. seaming defects) caused by countersink dimensional variations within an individual can end. The invention potentially reduces cutedge and improves buckle performance, and/or tab over chime. The inventors have discovered that reforming the can end according to the present invention in the conversion press rather than creating the final shape in the shell press leads to a more consistent shape of the can end from article to article. In other words, one of the benefits of the present invention is a more consistent product with less variability.

It follows that in a method of the invention, a can end shell 100 formed in a shell press is provided. The shell 100 has a public side 34 and an opposing product side 35, and a circumferential curl 14 is located about a center axis 50 and defines an outer perimeter of the can end shell 100. A circumferential wall 15 extends downwardly from the curl 14. A circumferential, generally U-shaped countersink 16 extends radially inwardly from the circumferential wall 15 relative to the center axis 50 and upwardly. A center panel 12 extends radially inwardly from the countersink 16 relative to the center axis 50. A circumferential panel joins the countersink 16 with the center panel 12. At this point, the shell 100 does not have a tab 26 fixed to the public side 34 and a displaceable tear panel 20 defined by frangible score 22 and a hinge segment 25.

The provided can end shell 100 includes dimensional variability about the circumference of the generally U-shaped countersink 16. The embodiments illustrated in FIGS. 1-22 show a countersink 16 with a compound radius, i.e. a countersink having a radially outer annular curved portion having a radius of curvature less than a radially inner annular curved portion of the U-shaped countersink 16. Less preferably, the radially inner annular curved portion of the countersink has a radius of curvature less than a radius of curvature of the radially outer annular curved portion of the countersink 16. Or, as shown in FIGS. 23 and 24, the countersink 16 may have a more uniform structure wherein the radially outer curved portion is substantially equal to the radially inner radius of curvature.

The can end shell 100 is reformed in a conversion press. In the conversion press process, the tear panel 20, tab 26 and other center panel features are added to the can end as required and as described above and illustrated in FIGS. 1 and 2. The features illustrated in any of FIGS. 5-22 and described above may also be imparted to the can end shell 100 during the conversion process. Further, dimensional variability in the countersink 16 of the can end shell 100 can be removed in the conversion press. This is accomplished by reforming the countersink 16 in the conversion press wherein the converted can end has a countersink 16 that is more uniform and dimensionally consistent about the circumference of the countersink 16. This will improve the overall resistance to buckle of the can end because dimensional inconsistency about the circumference of countersink 16 provides stress-rising sites where buckle can be initiated. Removal of the dimensional variability by reforming the can end shell in the conversion press according to the present invention improves can end strength and performance by removing weak spots or stress-rising sites.

A radius of curvature of the radially outer curved portion of the countersink 16 and/or the radially inner curved portion of the countersink 16 may be decreased. This may coincide with an increase in the length/height of the inner wall 72 of the countersink 16 and/or the decreasing of the angle of the inner wall 72 of the countersink 16. Of course, one or more of the features described above may be introduced to the circumferential panel as well.

Figure 23:
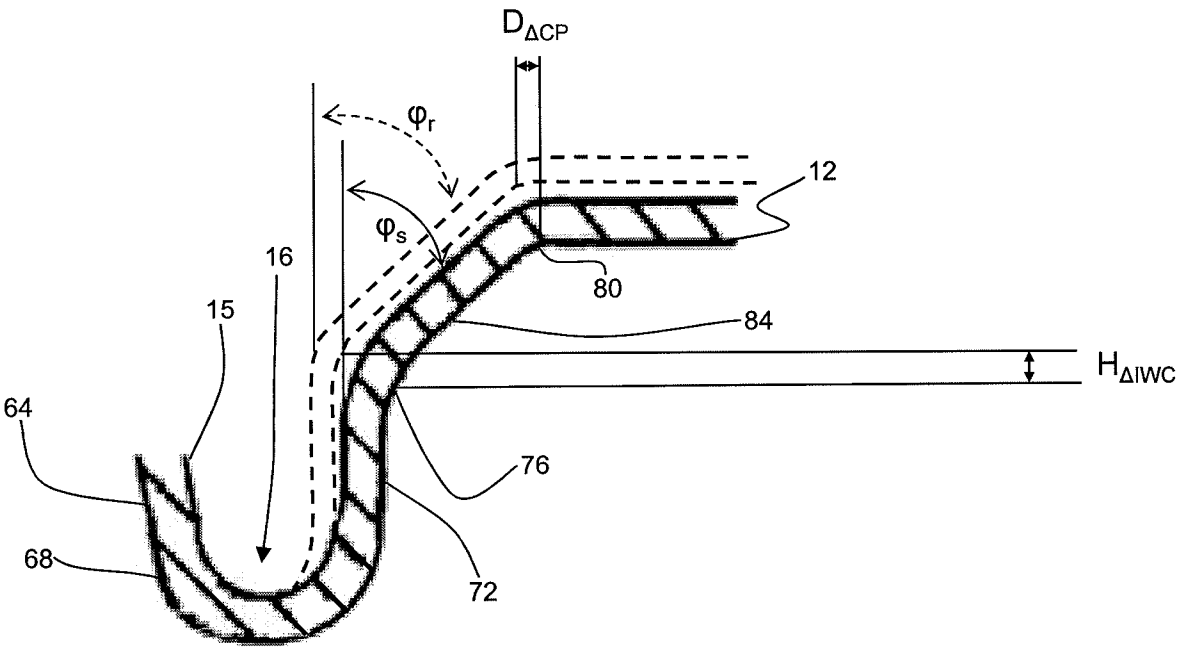
FIG. 23 is a partial cross-sectional view of a reformed can end in dashed lined and an unreformed can end shell in solid lines illustrating one aspect of the present invention, namely a reformed inner wall of a U-shaped countersink having an increased length/height and a reduced angle; the circumferential panel also exhibits a reduced angle relative the unreformed can end shell.
Figure 24:
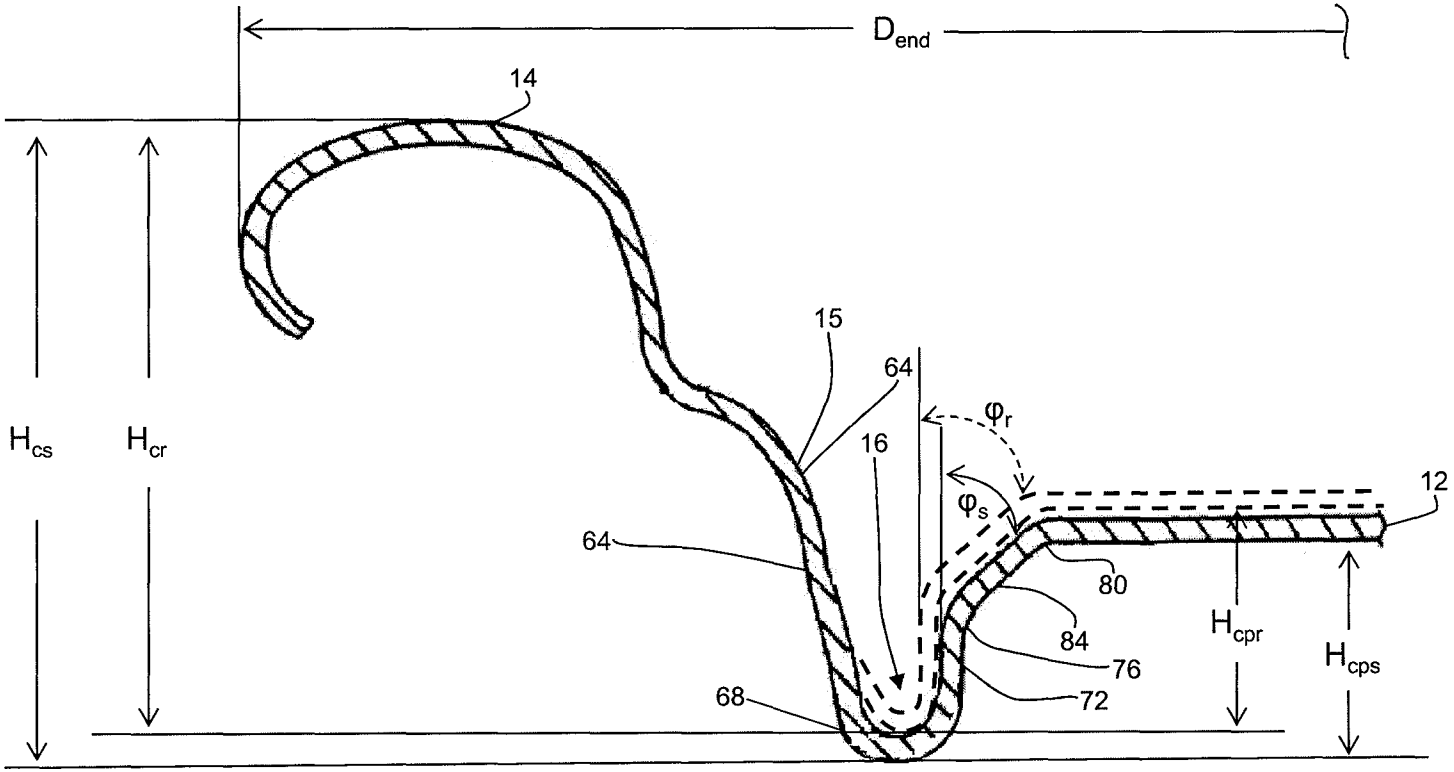
FIG. 24 is a partial cross-sectional view of a reformed can end in dashed lined and an unreformed can end shell in solid lines illustrating one aspect of the present invention, namely a reformed U-shaped countersink to tighten or decrease the radii of curvature of the radially inner and radially outer annular portions of the countersink.

As illustrated in FIGS. 23 and 24, the countersink 16 of a can end shell 100 (shown in solid lines) is provided with radially inner and outer annular curved portions that are substantially equal. The reformed can end is shown in dashed lines.

In FIG. 23, the shell 100 is reformed in a similar manner to the reform shown in FIG. 5. The inner wall 72 of the countersink is made more vertical, i.e. the angle of the inner wall 72 is decreased as measured from a vertical axis. A length/height of the inner wall 72 is increased. A change in the length/height of the inner wall 72 subsequent to reform is shown as $H_{\Delta IWC}$. A diameter of the center panel is increased. A change in the diameter of the center panel 12 subsequent to reform is shown as $D_{\Delta CP}$. An angle $\varphi_s$ of the circumferential panel may be decreased to an angle $\varphi_r$ from about 45° to as low as 30°.

In FIG. 24, the shell 100 countersink 16 is reformed to tighten or decrease the radii of curvature of the radially inner and radially outer annular portions of the countersink 16. The lower portion 64 of the chuck wall 15 and the outer wall 68 of the countersink are also reformed to increase an angle of those portions relative to a vertical axis. A shell height $H_{cs}$ of the curl 14 above a lowermost portion of the countersink is decreased subsequent to reform to $H_{cpr}$, beginning at about 0.240 to 0.242 ins and reformed to about 0.236 ins. A height of the center panel $H_{cps}$ is very slightly increased to a height $H_{cpr}$. A diameter of the center panel 12 is relatively unchanged. The inner wall 72 of the countersink is made more vertical, i.e. the angle of the inner wall 72 is decreased as measured from a vertical axis. A length/height of the inner wall 72 is increased.

The inventors further contemplate taking the shell illustrated in FIG. 24, for example, provided with radially inner and outer annular curved portions of the countersink 16 that are substantially equal, and reforming the countersink 16 to the profile shown in FIGS. 6-22, namely having a compound radius structure with a radially inner annular curved portion radius of curvature within the range of about 0.037 ins to about 0.040 ins and a radially outer annular curved portion having a radius of curvature with the range of about 0.01 ins to about 0.037 ins.

The terms "first," "second," "upper," "lower," "top," "bottom," etc. are used for illustrative purposes relative to other elements only and are not intended to limit the embodiments in any way. The term "plurality" as used herein is intended to indicate any number greater than one, either disjunctively or conjunctively as necessary, up to an infinite number. The terms "joined," "attached," and "connected" as used herein are intended to put or bring two elements together so as to form a unit, and any number of elements, devices, fasteners, etc. may be provided between the joined or connected elements unless otherwise specified by the use of the term "directly" and/or supported by the drawings.

While the specific embodiments have been illustrated and described, numerous modifications come to mind without significantly departing from the spirit of the invention and the scope of protection is only limited by the scope of the accompanying Claims.

What is claimed is:

1. A can end comprising:

a public side and an opposing product side wherein a thickness of the can lid measured between the public side and the product side is less than 0.0082 ins;

a circumferential curl located about a center axis and defining an outer perimeter of the can end;

a circumferential wall extending downwardly from the curl;

a circumferential, generally U-shaped countersink extending radially inwardly from the circumferential wall relative to the center axis and upwardly;

a center panel extending radially inwardly from the countersink relative to the center axis comprising a displaceable tear panel defined by frangible score and a hinge segment on the public side and a tab fixed to the public side having a nose portion overlying a portion of the displaceable tear panel; and a circumferential panel joining the countersink with the center panel comprising a first panel radius and a second panel radius, the circumferential panel having one or more features formed therein providing locally additional material from which to form a substantially vertical, radially inner wall of the countersink having a sufficient length wherein the can end exhibits a buckle strength greater than or equal to 100 psi, wherein a first feature is a coin in the circumferential panel wherein a thickness of a material of the coin is less than a thickness of a material of the upper panel radius and the lower panel radius, and wherein the coin has a length less than a length of the circumferential panel and a thickness of a material of the coin is less than a thickness of a material of portions of the circumferential panel between the coin and the upper panel radius and the coin and the lower panel radius.

2. The can end of claim 1 wherein the circumferential panel has a lowermost point and an uppermost point wherein an angle of a straight line drawn from the lowermost point to the uppermost point is between 30° and 60°.

3. The can end of claim 2 wherein a segment of the circumferential panel between the first and second points lies on the straight line.

4. The can end of claim 2 wherein a first feature is a concave bead relative to the public side.

5. The can end of claim 2 wherein a first feature is a coined segment of either the first panel radius or the second panel radius.

6. The can end of claim 1 wherein the circumferential panel has a lowermost point and an uppermost point wherein an angle of a straight line drawn from the lowermost point to the uppermost point is about 45° and wherein a segment of the circumferential panel between the first and second points lies on the straight line.

7. A can end comprising:

a public side and an opposing product side wherein a thickness of the can lid measured between the public side and the product side is less than 0.0082 ins;

a circumferential curl located about a center axis and defining an outer perimeter of the can end;

a circumferential wall extending downwardly from the curl;

a circumferential, generally U-shaped countersink extending radially inwardly from the circumferential wall relative to the center axis and upwardly;

a center panel extending radially inwardly from the countersink relative to the center axis comprising a displaceable tear panel defined by frangible score and a hinge segment on the public side and a tab fixed to the public side having a nose portion overlying a portion of the displaceable tear panel;

a circumferential panel joining the countersink with the center panel;

an upper panel radius joining the circumferential panel to the center panel; and a lower panel radius joining the circumferential panel to the countersink, wherein a radius of curvature of a bend in the circumferential panel is not equal to a radius of curvature of the upper panel radius and a radius of curvature of the lower panel radius, wherein the circumferential panel has one or more features formed therein providing locally additional material from which to form a substantially vertical, radially inner wall of the countersink having a sufficient length wherein the can end exhibits a buckle strength greater than or equal to 100 psi, wherein a first feature is a coin in the circumferential panel wherein a thickness of a material of the coin is less than a thickness of a material of the upper panel radius and the lower panel radius, and wherein the coin has a length less than a length of the circumferential panel and a thickness of a material of the coin is less than a thickness of a material of portions of the circumferential panel between the coin and the upper panel radius and the coin and the lower panel radius.

8. The can end of claim 7 wherein the radius of curvature of the upper panel radius is not equal to the radius of curvature of the lower panel radius.

9. The can end of claim 7 wherein the radius of curvature of the upper panel radius is less than the radius of curvature of the lower panel radius.

10. The can end of claim 7 wherein the radius of curvature of the upper panel radius is greater than the radius of curvature of the lower panel radius.

11. The can end of claim 10 wherein the upper panel radius, the lower panel radius, and the bend are concave bends from a reference point on the product side of the can end.

12. The can end of claim 7 wherein the bend of the circumferential panel has a greater radius of curvature than the radius of curvature of the upper panel radius and the radius of curvature of the lower panel radius.

13. The can end of claim 7 wherein the circumferential panel has a lowermost point and an uppermost point wherein an angle of a straight line drawn from the lowermost point to the uppermost point is between about 30 and 60° and wherein a segment of the circumferential panel between the first and second points lies on the straight line, the circumferential panel having a feature formed therein providing additional material of the thickness from which to form a substantially vertical radially inner wall of the countersink wherein the feature comprises a convex bend relative to the public side.

14. The can end of claim 1 wherein at least one of the one or more features comprises a bead formed in the circumferential panel, the bead being a formation in the can end wherein deformation of the public side and the product side are substantially uniform, such that the public side and the product side remain substantially parallel throughout a bead structure.

15. The can end of claim 14 wherein the bead has an arcuate shape in cross-section, wherein the circumferential panel includes the lower panel radius separated from the upper panel radius by a generally upwardly and inwardly extending short wall having a first segment extending radially inwardly relative to the center axis, a second segment comprising the bead, and a third segment extending upwardly from the bead.

* * * * *